US005250409A

United States Patent [19]

Yasunami et al.

[11] Patent Number: 5,250,409

[45] Date of Patent: Oct. 5, 1993

[54] SILVER HALIDE PHOTOGRAPHIC MATERIAL

[75] Inventors: Shoichiro Yasunami; Yasuo Mukunoki, both of Kanagawa, Japan

[73] Assignee: Fuji Photo Film Co., Ltd., Kanagawa, Japan

[21] Appl. No.: 935,336

[22] Filed: Aug. 27, 1992

Related U.S. Application Data

[63] Continuation of Ser. No. 548,646, Jul. 5, 1990, abandoned.

[30] Foreign Application Priority Data

Jul. 5, 1989 [JP] Japan ..... 1-173500

[51] Int. Cl.[5] ..... G03C 1/35

[52] U.S. Cl. ..... 430/927; 430/518; 430/523; 430/641

[58] Field of Search ..... 430/527, 518, 641, 523

[56] References Cited

U.S. PATENT DOCUMENTS 3,758,445 9/1973 Cohen et al. ..... 430/518
3,948,663 4/1976 Shiba et al. ..... 430/518
4,876,167 10/1989 Snow et al. ..... 430/518

*Primary Examiner*—Jack P. Brammer
*Attorney, Agent, or Firm*—Sughrue, Mion, Sinn, Macpeak & Seas

[57] ABSTRACT

A silver halide photographic material which comprises a support having thereon one or more constituent layers including at least one silver halide emulsion layer, wherein at least one of said constituent layers is a layer formed by (a) coating a composition which contains a high molecular weight compound having at least one repeating unit represented by the following formula (I), and then (b) making the composition undergo a cross-linking reaction:

(I)

wherein $R_1$ represents a hydrogen atom, an alkyl group, a chlorine atom, or a cyano group; $R_2$ and $R_3$, which may be the same or different, each represents an alkyl group; $L_1$ and $L_2$ each represents a divalent linking group; Y represents —O—, or wherein $R_4$ represents a hydrogen atom, or an alkyl group; X represents a crosslinking group containing an activated vinyl component; and Z represents a counter ion for balancing the electric charge.

8 Claims, No Drawings

SILVER HALIDE PHOTOGRAPHIC MATERIAL

This is a continuation of application Ser. No. 07/548,646 filed Jul. 5, 1990, now abandoned.

FIELD OF THE INVENTION

This invention relates to a silver halide photographic material having excellent antistatic property. More particularly, the present invention relates to a silver halide photographic material (hereinafter abbreviated as "photographic material") which is imbued with excellent antistatic property without causing an adverse effect on the coating facility property of the photographic film or causing contamination problems in any processing solutions used in the photographic processing as performed with an automatic developing machine. Also, the tendency of the photographic material to suffer dust adhesion after photographic processing is inhibited due to the antistatic property imparted to the photographic film. Further, the present invention relates to a method for producing such a photographic material having excellent antistatic property.

BACKGROUND OF THE INVENTION

Photographic material is conventionally constructed as a multilayered element including an electrically insulating support and photographic light-sensitive emulsion layers. This photographic material is susceptible to accumulation of electrostatic charges caused by repeated frictional contacts between the photographic material with surfaces of the same or different kinds of materials, or during peeling operations performed in order to separate superposed materials of the same or different kinds during the manufacture of, or use of, the photographic material. These accumulated electrostatic charges can cause many problems. The most serious problem being that the light-sensitive emulsion layers can be inadvertently sensitized by the discharge of these accumulated electrostatic charges before development processing is performed which results in the generation of dot-like spots, or dendritic or feather-like streaks in the development processed photographic film. These spots and streaks are generally called static marks, and considerably diminish, if not destroy, the commercial value of the photographic film.

Further, these accumulated electrostatic charges are also responsible for other problems. For instance, since the electrostatic charge-accumulated film surface on a photographic film is subject to dust particle adhesion, application of a uniform coating on the electrostatic charge-accumulated surface is not possible.

Generation of electrostatic charges is, as described above, due to physical contact and separation operations encountered in the course of the production of photographic materials, and due to physical contact and separation of a photographic film with a wide variety of machine parts inside an automatic camera. In recent years in particular, photographic materials have been designed so as to have higher photographic speed and are frequently subjected to harsh treatments such as high speed coating, high speed photographing, high speed processing with an automatic developing machine, for example, which have increased the potential for the generation of static marks. In addition, processed films have been subject to dust adhesion during handling in various ways.

In order to eliminate these problems, it is desirable to add an antistatic agent to a photographic material. However, conventional antistatic agents generally employed in other fields cannot necessarily be applied to photographic materials due to requirements unique to photographic material technology. In this regard, antistatic agents to be used in photographic materials are required to possess not only excellent ability to prevent electrification but also other important properties. For example, the antistatic agent cannot have adverse effects on other photographic characteristics including sensitivity, fog, graininess, sharpness, film strength and adhesiveness of photographic materials. Also, the antistatic agent cannot contaminate processing solutions for photographic materials and can not hasten the fatigue of such processing solutions; it cannot pollute carrier rollers, and it cannot lower the adhesion power between each pair of adjacent constituent layers, for example.

One method for the elimination of problems arising from static electricity consists in designing a photographic material such that electric conductivity of the photographic material's surfaces may be enhanced to enable accumulated electrostatic charges to be scattered and lost in a short time before the discharge occurs. In particular, this method becomes an effective measure against dust adhesion after processing.

Therefore, a wide variety of methods for increasing electrical conductivities of a support and every sort of coating provided at the surface of a photographic material have been previously proposed, and utilization of various hygroscopic substances, water-soluble inorganic salts, certain kinds of surface active agents and polymers, and so on, have been attempted.

However, these electrical conductivity increasing substances each suffer from their own individual disadvantages. For example, some of these substances are specific in their ability depending on the kind of a film support used and the variation in photographic composition used, and some of them lose electrical conductivities after processing which allows dust adhesion, and some of them have humidity sensitivity resulting in generation of static marks under a low humidity condition, and some of them cause a deterioration in other photographic properties such as coating facility and transparency, and some of them adversely affect adhesiveness of the photographic film, and others contaminate a development processing solution used. Consequently, the application of such substances to photographic materials has proven difficult.

SUMMARY OF THE INVENTION

A first object of the present invention is to provide a photographic material which is effectively prevented from accumulating electrostatic charges, regardless of the type of materials with which the photographic film is brought into contact.

A second object of the present invention is to provide a photographic material which retains excellent antistatic property even after photographic processing is performed to result in enhancement of an ability to prevent dust from adhering thereto.

A third object of the present invention is to provide a photographic material which is prevented from accumulating electrostatic charges without contaminating any processing solution.

A fourth object of the present invention is to provide a photographic material which is prevented from accumulating electrostatic charges without exerting any adverse effect upon transparency property of the photographic film.

A fifth object of the present invention is to provide a photographic material which is prevented from accumulating electrostatic charges without suffering from deterioration of adhesiveness, before or after development processing.

The above described objects are attained with a photographic material which comprises a support having thereon one or more constituent layers including at least one silver halide emulsion layer, wherein at least one of said constituent layers is a layer formed by (a) coating a composition which contains a high molecular weight compound having at least one repeating unit represented by the following formula (I), and then (b) making the composition undergo a crosslinking reaction:

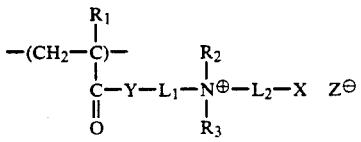

(I)

wherein $R_1$ represents a hydrogen atom, an alkyl group, a chlorine atom, or a cyano group; $R_2$ and $R_3$, which may be the same or different, each represents an alkyl group; $L_1$ and $L_2$ each represents a divalent linking group; Y represents —O—, or

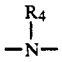

wherein $R_4$ represents a hydrogen atom, or an alkyl group; X represents a crosslinking group containing an activated vinyl component; and Z represents a counter ion for balancing the electric charge.

DETAILED DESCRIPTION OF THE INVENTION

The high molecular weight compounds used in the present invention are excellent in antistatic ability due to quaternary ammonium groups present in their side chains, and further, unexpectedly, they can be prevented from experiencing lowered antistatic ability after development processing, and from contaminating a fixer bath, and can ensure the retention of excellent adhesiveness property by a photographic material owing to the crosslinking reaction undergone by the crosslinking groups present in their side chains, thus achieving the present invention.

Formula (I) is described in greater detail below.

$R_1$ represents a hydrogen atom, an alkyl group, a chlorine atom, or a cyano group, preferably a hydrogen atom, an alkyl group containing 1 to 6 carbon atoms or a chlorine atom, and more preferably a hydrogen atom, an alkyl group containing 1 to 3 carbon atoms, or a chloride atom. $R_2$ and $R_3$ may be the same or different, and each represents an alkyl group. Such an alkyl group may have a substituent group, with specific examples including a halogen atom (e.g., fluorine, chlorine, bromine), a cyano group, a sulfo group, a hydroxy group, a carboxyl group, an alkyl group, an aryl group, an aralkyl group, an acyloxy group, an acylamino group, an amino group, a sulfonamido group, an alkoxy group, an aryloxy group, an alkylthio group, an arylthio group, a carbamoyl group, a sulfamoyl group, an alkoxycarbonyl group, an aryloxycarbonyl group, an alkylsulfonyl group, an arylsulfonyl group, an alkoxysulfonyl group, an aryloxysulfonyl group, a carbamoylamino group, a sulfamoylamino group, a carbamoyloxy group, an alkoxycarbonylamino group, an aryloxycarbonylamino group.

In addition, $R_2$ and $R_3$ may undergo condensation to form a ring.

Alkyl groups preferred as $R_2$ and $R_3$ include those which contain 1 to 8 carbon atoms, and may have a substituent group. Among them, unsubstituted or substituted alkyl groups containing 1 to 4 carbon atoms are preferred over others.

Y represents —O—, or

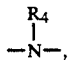

and $R_4$ represents a hydrogen atom or an alkyl group. Groups preferred as Y include —O— and

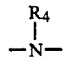

(wherein $R_4$ represents a hydrogen atom or an alkyl group containing 1 to 8 carbon atoms). Among them —O— and

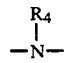

(wherein $R_4$ represents a hydrogen atom or an alkyl group containing 1 to 4 carbon atoms) are preferred over others.

$L_1$ and $L_2$ may be the same or different, and they are specifically represented by formula (II):

$$-(L_3)_a-(A-L_4)_b-(B-L_5)_c-(C)_d- \quad \text{(II)}$$

In the above formula, $L_3$ and $L_5$ each represents an alkylene group, an arylene group or a combination thereof, and $L_4$ represents $-CH_2CH_2-$ or

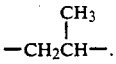

The coefficients a, c and d each represents 0 or 1, and b represents an integer from 0 to 30. However, the case a=b=c=d, 0 is excluded therefrom. A, B and D may be the same or different, and each represents —O—, —S—, —NH—,

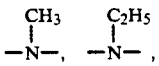

—O—CO—, $-CO_2-$, —CO—, —CONH—, or —NH-CO—.

Examples of divalent linking groups preferred as $L_1$ and $L_2$ include, for example, $-CH_2-$, $-(CH_2)_2-$, $-(CH_2)_3-$, $-(CH_2)_4-$, $-(CH_2)_6-$,

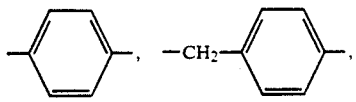

-continued

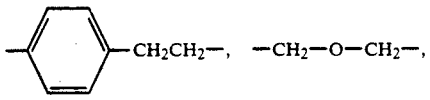

$-CH_2CH_2-O-CH_2CH_2-$, $-CH_2CH_2-NH-CH_2-CH_2-$, $-CH_2CH_2\left(O-CH_2CH_2\right)_2-$, $-CH_2CH_2\left(O-CH_2CH_2\right)_3-$, $-CH_2CH_2\left(O-CH_2CH_2\right)_4-$, $-CH_2CH_2\left(O-CH_2CH_2\right)_7-$, $-CH_2CH_2\left(O-CH_2CH_2\right)_9-$, $-CH_2CH_2\left(O-CH_2CH_2\right)_2OC(=O)-CH_2-$, $-CH_2CH_2\left(O-CH_2CH_2\right)_2OC(=O)\left(CH_2\right)_3-$, $-CH_2CH_2\left(O-CH_2CH_2\right)_9O-C(=O)-C\left(CH_2\right)_3-$, $-CH_2CH_2-(O-CH_2CH_2)_4-NHCO-(CH_2)_3-$.

Among these divalent linking groups, those containing 1 to 30 carbon atoms are preferred over others. Further, these groups may have a substituent group. Examples of a substituent group by which the foregoing alkylene groups may be substituted include those described as examples for $R_2$ and $R_3$.

Among these divalent linking groups, examples of a substituent group by which the foregoing arylene groups may be substituted include alkyl groups containing 1 to 20 carbon atoms, substituted alkyl groups, halogen atoms (e.g., fluorine, chlorine, bromine), hydroxyl groups, carboxyl groups, sulfo groups, acylamino groups, sulfonamido groups, carbamoyl groups, acyloxy groups, alkoxycarbonyl groups, acyl groups, alkoxy groups, aryloxy groups, nitro groups, formyl groups, alkylsulfonyl groups and arylsulfonyl groups. Two or more of these groups may be substituted for hydrogens of the foregoing arylene groups.

X is a crosslinking group containing an activated vinyl component, and represented by formulae (III) or (IV).

$$-V_1-C(=O)\left(CH=CH\right)_pT_1 \quad \text{(III)}$$

$$\left(T_2\right)_q\left(CH=CH\right)_pC(=O)-V_2-R_7 \quad \text{(IV)}$$

In the foregoing formulae (III) and (IV), $V_1$ and $V_2$ each has the same meaning as Y. $T_1$ represents an aryl group,

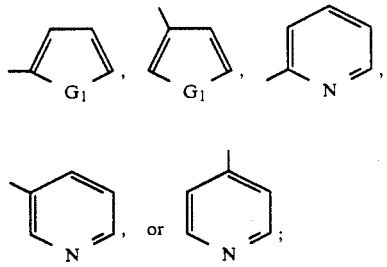

and $G_1$ represents —O—, —S—, or $$-\overset{R_4}{\overset{|}{N}}-$$

(wherein $R_4$ has the same meaning as described above). Also, these groups each may have substituent group(s). Examples of such substituent groups include those given as examples for the arylene group represented by $L_1$.

Groups preferred as $T_1$ are, for example,

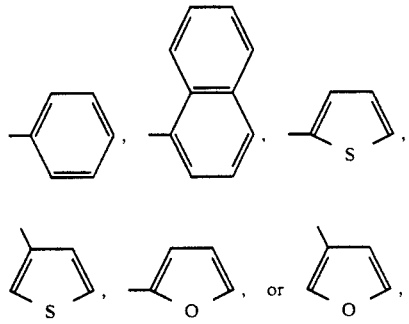

which each may have a substituent group.

$T_2$ represents an arylene group,

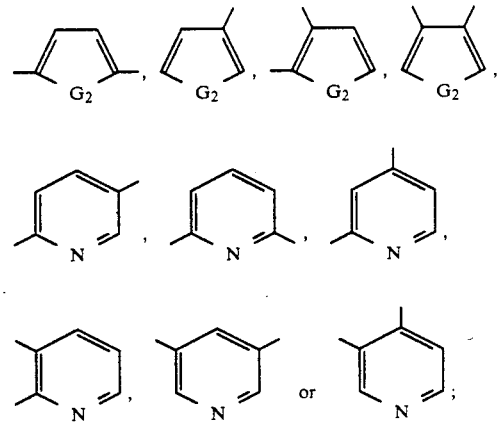

and $G_2$ has the same meaning as $G_1$. Also, these groups each may have substituent group(s). Examples of such substituent group(s) include those given as examples for the arylene group represented by $L_1$. Groups preferred as $T_2$ include, for example,

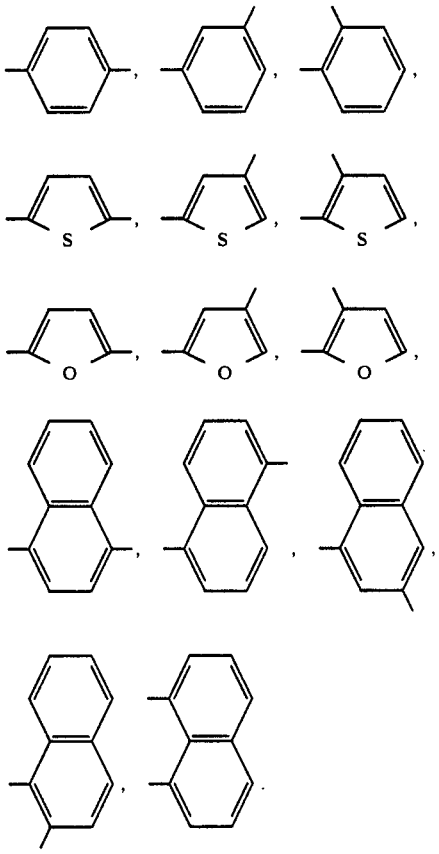

$R_7$ represents a hydrogen atom, an alkyl group, an alkenyl group, an aryl group or an aralkyl group, and these alkyl, alkenyl, aryl and aralkyl groups each may have substituent group(s). Examples of s substituent group by which the alkyl and alkenyl groups may be substituted include those given as examples for the alkyl group represented by $R_2$. Examples of substituent groups by which the aryl and aralkyl groups may be substituted include those given as examples for the arylene group represented by $L_1$.

Those which are preferred as $R_7$ include a hydrogen atom, alkyl groups containing 1 to 10 carbon atoms or aryl or aralkyl groups containing 6 to 15 carbon atoms. More preferred ones are a hydrogen atom, alkyl groups containing 1 to 6 carbon atoms (e.g., methyl, ethyl, propyl), phenyl, and aralkyl groups containing 7 to 10 carbon atoms (e.g., 4-methylphenyl, 4-t-butylphenyl).

p is 1 or 2, preferably 2, and q is 0 or 1.

Z in formula (I) is a counter ion for balancing the electric charge, with suitable examples including halogen ions (e.g., $Cl^-$, $Br^-$, $I^-$), $ClO_4^-$, $BF_4^-$, $PF_6^-$, $R_8$-$CO_2^-$ and $R_8$-$SO_3^-$. Herein $R_8$ represents a hydrogen atom, an alkyl group containing 1 to 10 carbon atoms or an aryl or aralkyl group containing 6 to 10 carbon atoms. When $R_8$ represents an alkyl, aryl or aralkyl group, such a group may also have a substituent group. Examples of a substituent group by which the alkyl group may be substituted include those given as examples for the alkyl group represented by $R_2$. Examples of substituent groups by which the aryl and aralkyl groups may be substituted include those given as examples for the arylene group represented by $L_1$.

Specific examples of a group preferred as X include

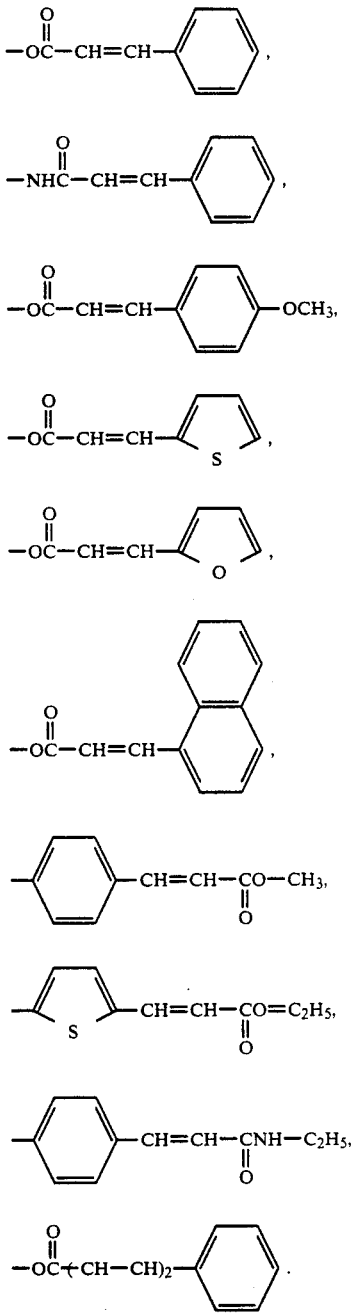

The antistatic ability provided by the high molecular weight compounds of the present invention can be enhanced by including another repeating unit represented by the following formula (V) in addition to the foregoing repeating unit represented by formula (I):

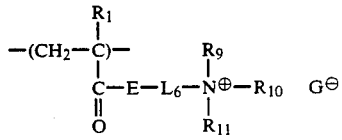

(V)

wherein $R_1$ has the same meaning as $R_1$ in formula (I); $R_9$, $R_{10}$ and $R_{11}$ may be the same or different, each having the same meaning as $R_2$ in formula (I) and any two or all of $R_9$, $R_{10}$ and $R_{11}$ may be condensed together to complete a ring; and E, $L_6$ and G have the same meanings as Y, $L_1$ and Z in formula (I), respectively.

Typical representative monomers from which the repeating units represented by formula (I) are derived are illustrated below. Of course, the invention should not be construed as being limited to the following examples.

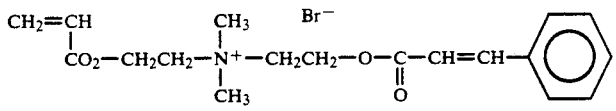

(C-1)

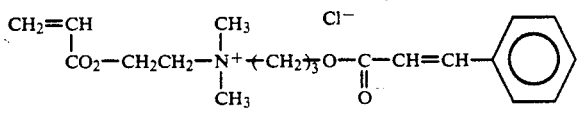

(C-2)

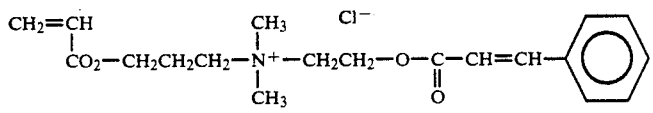

(C-3)

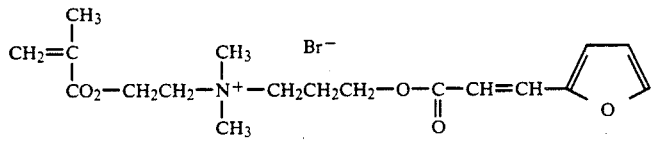

(C-4)

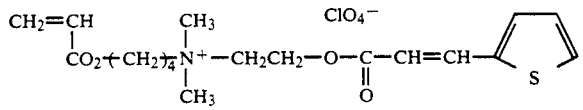

(C-5)

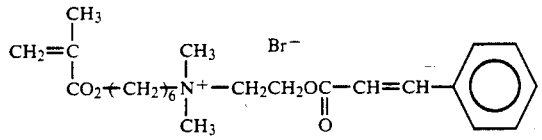

(C-6)

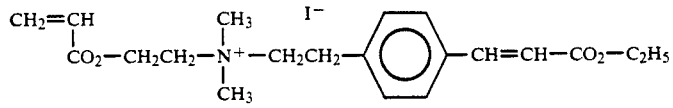

(C-7)

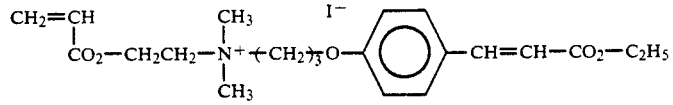

(C-8)

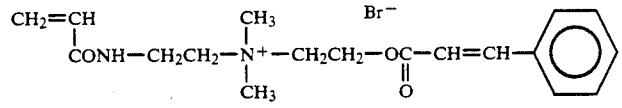

(C-9)

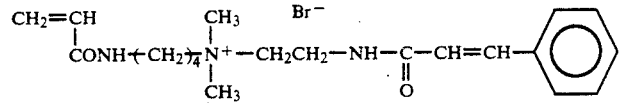

(C-10)

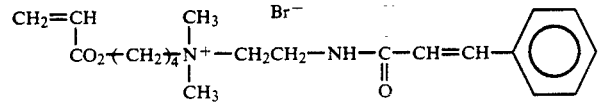

(C-11)

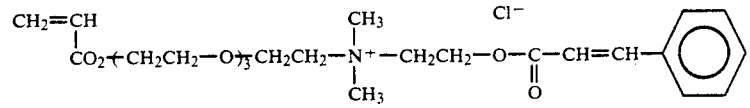

(C-12)

-continued
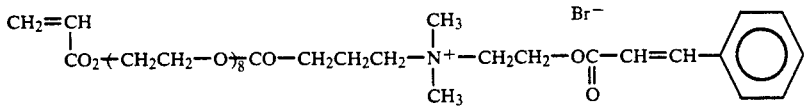
(C-13)
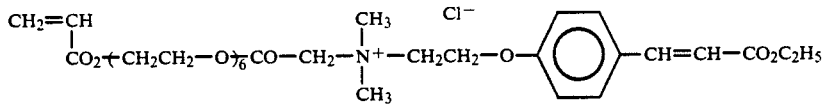
(C-14)
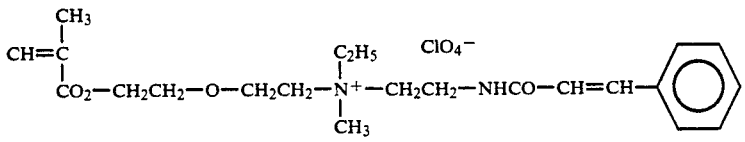
(C-15)
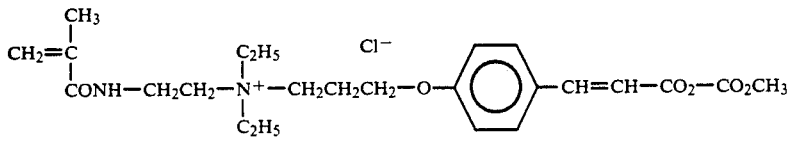
(C-16)
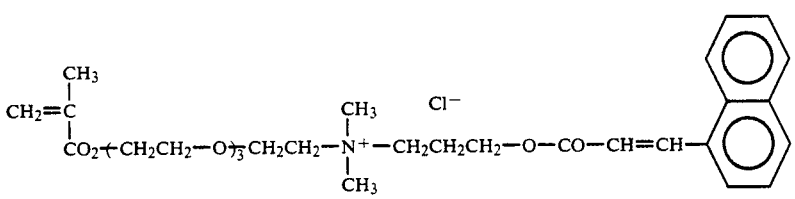
(C-17)
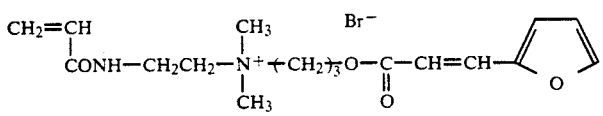
(C-18)
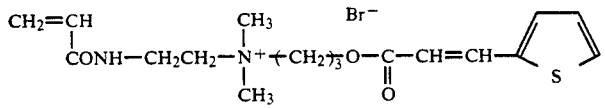
(C-19)
Typical examples of monomers from which the repeating units represented by formula (V) are derived are illustrated below. Of course, the invention should not be construed as being limited to the following examples.
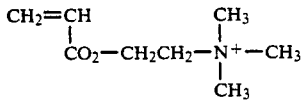
(D-1)
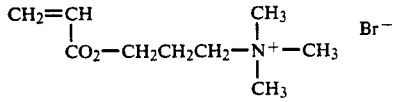
(D-2)
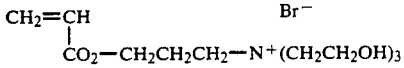
(D-3)
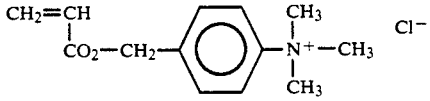
(D-4)
-continued
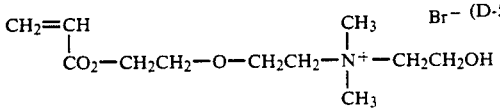
(D-5)
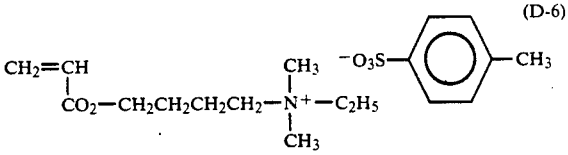
(D-6)
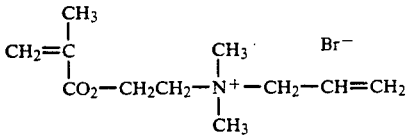
(D-7)
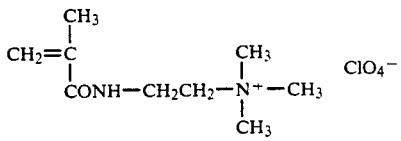
(D-8)

-continued

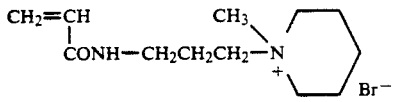

(D-9)

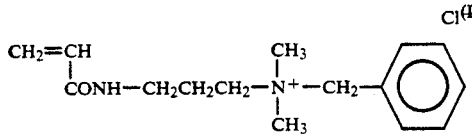

(D-10)

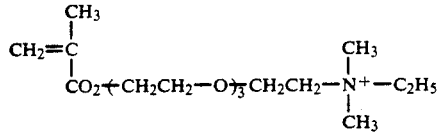

(D-11)

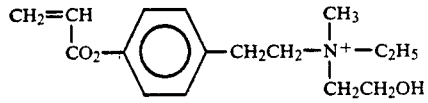

(D-12)

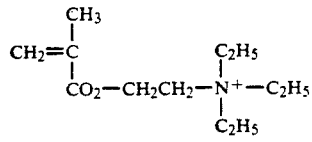

(D-13)

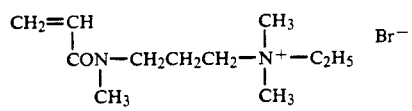

(D-14)

In addition to the foregoing repeating units represented by formulae (I) or (V), the high molecular weight compounds to be used in the present invention may contain additional repeating units derived from other monomer components.

Suitable examples of other monomer components include acrylic acid, α-chloroacrylic acid, α-alacrylic acids (e.g., methacrylic acid), esters and amides derived from these acrylic acids (e.g., acrylamide, methacrylamide, n-butylacrylamide, t-butylacrylamide, diacetonacrylamide, methylacrylate, ethylacrylate, n-propylacrylate, n-butylacrylate, t-butylacrylate, 2-ethylhexylacrylate, n-octylacrylate, laurylacrylate, methylmethacrylate, ethylmethacrylate, β-hydroxymethacrylate), vinyl esters (e.g., vinyl acetate, vinyl propionate, vinyl laurate), acrylonitrile, methacrylonitrile, aromatic vinyl compounds (e.g., styrene and its derivatives, such as vinyltoluene, divinylbenzene, vinylacetophenone), itaconic acid, citraconic acid, crotonic acid, vinylidene chloride, vinyl alkyl ethers (e.g., vinyl ethyl ether), maleic acid esters, N-vinyl-2-pyrrolidone, N-vinylpyridine, 2- and 4-vinylpyridines.

In the high molecular weight compounds to be used in the present invention, the repeating unit represented by formula (I) is preferably contained in a fraction of from 2 to 60 mol %, particularly from 5 to 40 mol %.

Also, each of the high molecular weight compounds to be used in the present invention may have plural repeating units belonging to formula (I).

In the high molecular weight compounds to be used in the present invention, the repeating unit represented by formula (V) is preferably contained in a fraction of from 0 to 98 mol %, particularly from 60 to 95 mol %.

A weight average molecular weight (based on polyethylene oxide) of the high molecular weight compounds to be used in the present invention ranges preferably from 2,000 to 2,000,000, and more preferably from 5,000 to 1,000,000.

Typical representatives of the high molecular weight compounds to be used in the present invention are illustrated below. Of course, the invention should not be construed as being limited to these examples.

TABLE 1

| Example | Monomer of Formula (I) X | Monomer of Formula (V) Y | Other Monomers Z | X/Y/Z (by mol) |
|---|---|---|---|---|
| P-1 | C-1 | D-1 | — | 20/80/0 |
| P-2 | C-1 | D-2 | — | 10/90/0 |
| P-3 | C-1 | D-3 | — | 30/70/0 |
| P-4 | C-2 | — | — | 100/0/0 |
| P-5 | C-2 | D-12 | — | 40/60/0 |
| P-6 | C-3 | D-1 | — | 25/75/0 |
| P-7 | C-4 | D-7 | — | 20/80/0 |
| P-8 | C-6 | D-1 | — | 15/85/0 |
| P-9 | C-6 | D-6 | — | 45/55/0 |
| P-10 | C-8 | D-1 | — | 30/70/0 |
| P-11 | C-8 | D-3 | — | 30/70/0 |
| P-12 | C-5 | D-13 | — | 30/70/0 |
| P-13 | C-12 | D-2 | — | 20/80/0 |
| P-14 | C-12 | D-10 | — | 35/65/0 |
| P-15 | C-15 | D-3 | — | 10/90/0 |
| P-16 | C-15 | D-8 | — | 40/60/0 |
| P-17 | C-15 | D-11 | — | 40/60/0 |
| P-18 | C-1 | D-1 | Acrylamide | 25/70/5 |
| P-19 | C-7 | D-3 | Acrylic acid | 20/65/15 |
| P-20 | C-7 | — | — | 100/0/0 |
| P-21 | C-5 | D-5 | — | 20/80/0 |
| P-22 | C-5 | D-7 | — | 30/70/0 |
| P-23 | C-13 | D-1 | — | 25/75/0 |
| P-24 | C-2 | D-2 | — | 20/80/0 |
| P-25 | C-2 | D-9 | — | 30/70/0 |
| P-26 | C-10 | D-8 | — | 40/60/0 |
| P-27 | C-10 | D-14 | — | 30/70/0 |

The high molecular weight compounds of the present invention can be synthesized by polymerizing corresponding monomers by application of heat. Therein, a time required for polymerization can be reduced by adding in advance 0.01 to 5 mol % of a thermopolymerization initiator to the reaction system.

As for the thermopolymerization initiator, conventional ones can be employed, and suitable examples thereof include azobis compounds, peroxides, hydroperoxides, redox catalysts. More specifically, potassium persulfate, ammonium persulfate, t-butyl peroctoate, benzoyl peroxide, isopropyl percarbonate, 2,4-dichlorobenzoyl peroxide, methyl ethyl ketone peroxide, cumene hydroperoxide, azobisisobutyronitrile, 2,2'-azobis(2-amidinopropane)hydrochloride, and the like can be used.

A synthesis example of the high molecular weight compounds to be used in the present invention is described below.

SYNTHESIS EXAMPLE

Synthesis of Compound (P-1)

(1) Synthesis of 2-Bromoethylacrylate 12.5 g (0.1 mol) of 2-bromoethanol and 11 g (0.11 mol) of triethylamine were dissolved in 100 ml of chloroform, and cooled to 0° to 5° C. Thereto, 9 g (0.1 mol) of acrylic acid chloride was added dropwise over a 10 minute period with stirring. After completion of the dropwise addition, the temperature of the reaction mixture was returned to room temperature, and the stirring was further continued for 1 hour. Thereafter, the reaction mixture was washed with three 100 ml portions of water, and then the organic phase was collected. It was dried over anhydrous magnesium sulfate and filtered. The solvent was distilled away from the filtrate under reduced pressure. The residue was distilled under reduced pressure to give 14.8 g of the desired product (b.p. 95°-100° C./14 mm Hg) in an 83% yield. The chemical structure of the product was confirmed by NMR, IR and elemental analyses.

(2) Synthesis of 2-N,N-Dimethylaminoethylcinnamate 9 g (0.1 mol) of N,N-dimethylaminoethanol was dissolved in 100 ml of chloroform, and cooled to 0° to 5° C. Thereto, a chloroform solution containing 16.7 g (0.1 mol) of cinnamic acid chloride was added dropwise over a 20 minute period. After completion of the addition, the resulting solution was further stirred for 1 hour at room temperature. At completion of the reaction, chloroform was distilled away, and the residue was dissolved in 100 ml of water and treated with an equimolar amount of NaOH. The intended compound was extracted with three 100 ml portions of ether. The ether solutions were collected, dried over anhydrous magnesium sulfate, and filtered. The solvent was distilled away under reduced pressure, and then the residue was distilled to give 18.9 g of the desired product (b.p. 165°-175° C./1 mm Hg) in a 86.2% yield. The chemical structure of the product was confirmed by NMR, IR and elemental analyses.

(3) Synthesis of Monomer C-1

9.0 g (0.05 mol) of 2-bromoethylacrylate and 11.0 g (0.05 mol) of 2-N,N-dimethylaminoethylcinnamate were dissolved in 50 ml of dimethylformamide, and stirred in the presence of a trace amount of hydroquinone at 60° C. over a period of 72 hours while nitrogen gas was bubbled therethrough. After completion of the reaction, the solvent was distilled away under the reduced pressure, and the residue was recrystallized from acetonitrile-benzene mixed solvent. The yield was 15.6 g (86.2%). The chemical structure of the product was confirmed by NMR and elemental analyses.

(4) Synthesis of Monomer D-1

9.0 g (0.05 mol) of 2-bromoethylacrylate was dissolved in 50 ml of benzene, and placed in an ampule. Thereinto, 10-fold equivalent of trimethylamine gas was bubbled, and then the ampule was sealed. The reaction was run at 50° C. for 24 hours, and then the ampule was opened. The thus deposited white solid was filtered off, and washed thoroughly with benzene. The yield was 8.7 g (87%). The chemical structure of the product was confirmed by NMR and elemental analyses.

(5) Synthesis of Compound (P-1)

A 3 g portion (7.5 mol) of Monomer C-1 and a 7.1 g portion (0.03 mol) of Monomer D-1 were dissolved in 40 ml of ethanol, and were copolymerized in the presence of azobisisobutyronitrile at 50° to 60° C. for 4 hours. Thereafter, the solvent was distilled away, and the residue was dissolved in 30 ml of dimethyl sulfoxide and reprecipitated by the addition of 500 ml of hexane. This reprecipitation procedure was repeated two more times to obtain the desired compound. The yield was 8.6 g (85.1%), the weight average molecular weight ($M\bar{w}$: about 160,000), and the chemical structure was confirmed by GPC and elemental analysis.

The high molecular weight compound of the present invention is incorporated in at least one silver halide emulsion layer or another constituent layer of the photographic material. The constituent layers include, for example, a surface protecting layer, a backing layer, an interlayer, a subbing layer. Among those layers, a subbing layer is particularly preferred as the location of the high molecular weight compound(s).

When the subbing layer is constituted by two layers, either will do.

In applying the high molecular weight compounds of the present invention to the photographic material, they may be coated as they are, or may be dissolved or dispersed in a proper solvent and then coated in the form of a coating composition. Solvents usable therein include water, organic solvents such as methanol, ethanol, isopropanol, acetone, hexane, ethyl acetate, dimethyl sulfoxide, dioxane, chloroform, methylene chloride, toluene, benzene, ether, cyclohexanone, methyl ethyl ketone, for example, and mixtures of two or more of the above cited solvents.

As for the coating process, a dip coating process, an air knife coating process, a disk coating process, a gravure coating process, an extrusion coating process, a curtain coating process, a spray coating process, or an extrusion coating process using the hopper described in U.S. Pat. No. 2,681,294, or processes of coating simultaneously two or more layers disclosed in U.S. Pat. Nos. 3,508,947, 2,941,898, or 3,526,528, for example, or a process of soaking in a coating composition, may be employed.

In the present invention, the coated high molecular weight compounds undergo a crosslinking reaction through irradiation or heating, preferably irradiation. Radiation used preferably in the irradiation include ultraviolet rays, visible rays, electron beams and X-rays. In crosslinking the high molecular weight compounds by irradiation with radiation, it is desirable for a rapid progress of the crosslinking reaction that a radiation-sensitive agent should be added in advance. When the coat of the high molecular weight compound(s) is formed without using any solvent, it may be converted to a film by undergoing the crosslinking reaction as it is, but if the coating composition contains a solvent, then the coat may be crosslinked while the solvent is contained therein, and then subjected to the removal of the solvent (e.g., using an evaporating or washing method), resulting in the formation of a film of the high molecular weight compound(s). In the latter case, the solvent optionally may be removed prior to the crosslinking reaction. A condition for the irradiation can be arbitrarily chosen depending on the kind and the intensity of radiation to be employed.

Examples of sensitizers usable for the above described radiation crosslinkable reaction include benzophenone derivatives, benzanthrone derivatives, quinones, aromatic nitro compounds, naphthothiazoline derivatives, benzothiazoline derivatives, thioxanthones, naphthothiazole derivatives, ketocoumarin compounds, benzothiazole derivatives, naphthofuranone compounds, pyrylium salts, thiapyrylium salts. More specifically, Michler's ketone, N,N'-diethylaminobenzophenone, 1,2-benzanthraquinone, benzanthrone, (3-methyl-1,3-diaza-1,9-benz)anthrone, picramide, 5-nitroacenaphthene, 2,6-dichloro-4-nitroaniline, p-nitroaniline, 2-chlorothioxanthone, 2-isopropylthioxanthone, dimethylthioxanthone, methylthioxanthone-1-ethylcarboxylate, 2-nitrofluorene, 2-dibenzoylmethylene-3-methyl-naphthothiazoline, 3,3-carbonylbis(7-diethylaminocoumarin), 2,4,6-triphenylthiapyrylium perchlorate, 2-(p-chlorobenzoyl)naphthothiazole, Erythrocin, Rose Bengale, Eosine G, for example, can be used. These sensitizers are properly added in a proportion of about 1 to 20 wt. %, preferably 3 to 10 wt. %, to the high molecular weight compounds of the present invention.

When the crosslinking is carried out by heating, on the other hand, a reaction time can be reduced by using a known initiator, such as peroxides, azobis compounds, hydroperoxides and the like. In this case, an initiator is properly used in a proportion of 0.01 to 5 mol %, preferably 0.1 to 3 mol %, to the high molecular weight compounds of the present invention, and an appropriate heating temperature ranges from 40° to 150° C., preferably from 50° to 120° C.

Also, the layer containing the high molecular weight compounds of the present invention can contain other high molecular weight compounds in the form of blend.

As high molecular weight compounds which can be blended in the present invention, synthetic resins such as phenol resins, urea resins, melamine resins, silicone resins, vinylidene chloride resins, polystyrene resins, polyethylene resins, vinyl chloride resins and polyamide resins; synthetic rubbers such as styrenebutadiene rubber, butadiene rubber, isoprene rubbers, butyl rubber, nitrile rubber, chloroprene rubber and ethylene-propylene rubber; and polymers of polyvinyl acetate type, polymers of polystyrene type, polymers of polyethylene type, polymers of poly(meth)acrylate type, and so on are given as examples, but high molecular weight compounds usable for that purpose should not be construed as being limited to these examples.

It is desirable that the high molecular weight compounds of the present invention should be used in an amount of from 0.0001 to 2.0 g, preferably from 0.0005 to 1.0 g, especially from 0.001 to 0.5 g, per square meter of the photographic material.

The high molecular weight compounds of the present invention may be used as a mixture of two or more kinds thereof.

The photographic material relating to the present invention can be used as an ordinary black-and-white silver halide photographic material (e.g., a picture-taking black-and-white sensitive material, a black-and-white X-ray sensitive material, a black-and-white sensitive material for graphic arts), an ordinary multilayer color photographic material (e.g., a color negative film, a color reversal film, a color positive film, a color negative film for motion picture), and an infrared sensitive material for laser scanner, for example.

The photographic material of the present invention is not particularly restricted as to the kind, the preparation method, or the chemical sensitization method of the silver halides used in the silver halide emulsion layers, and further, is not restricted as to other constituents included in the silver halide emulsion layers, for example, the surface protecting layer, an antifoggant, a stabilizer, a hardener, a supplemental antistatic agent, couplers, a plasticizer, a lubricant, a coating aid, a matting agent, a brightening agent, spectral sensitizers, dyes, ultraviolet absorbers and so on. As for these constituents, the description in *Product Licensing*, Vol. 92, pp. 107 to 110 (December, 1971), *Research Disclosure*, Vol. 176, pp. 22 to 31 (December, 1978), and supra, Vol. 238, pp. 44 to 46 (1984) can be referred to.

In the photographic emulsion layers and other hydrophilic colloid layers of the photographic material prepared in accordance with the present invention, various surface active agents may be included as a coating aid, or for various other purposes, e.g., supplemental protection against electrification, enhancement of slippability, emulsifying dispersion, prevention of adhesion, improvements on photographic characteristics (e.g., acceleration of development, heightening of contrast, sensitization), and so on. Examples of surface active agents suitable for such purposes include nonionic surfactants such as saponin (of steroid type), alkylene oxide derivatives (e.g., polyethylene glycol, polyethylene glycol/polypropylene glycol condensates, polyethylene glycol alkyl ethers or polyethylene glycol alkyl aryl ethers, polyethylene glycol esters, polyethylene glycol sorbitan esters, polyalkylene glycol alkylamines or amides, polyethylene oxide adducts of silicone), glycidol derivatives (e.g., alkenylsuccinic acid polyglycerides, alkylphenol polyglycerides), fatty acid esters of polyhydric alcohols and alkyl esters of sugars, for example; anionic surfactants containing an acid group, e.g., a carboxy group, a sulfo group, a phospho group, a sulfate group, a phosphate group, etc., such as alkylcarboxylates, alkylsulfonates, alkylbenzenesulfonates, alkylnaphthalenesulfonates, alkylsulfates, alkylphosphates, N-acyl-N-alkyltaurines, sulfosuccinates, sulfoalkylpolyoxyethylene alkylphenyl ethers and polyoxyethylene alkylphosphates for example; amphoteric surfactants such as amino acids, aminoalkylsulfonic acids, aminoalkylsulfates, aminoalkylphosphates, alkylbetaines and amine oxides, for example; and cationic surfactants such as alkylamines, aliphatic or aromatic quaternary ammonium salts, heterocyclic quaternary ammonium salts such as pyridinium and imidazolium and aliphatic or heterocyclic phosphonium or sulfonium salts, for example.

Surface active agents as cited above are described in Ryohei Oda et al., *Synthesis and Applications of Surface Active Agents*, Maki Shoten (1964), Hiroshi Horiguchi, *New Surface Active Agents*, Sankyo Shuppan (1975), *Mc Cutcheon's Detergents & Emulsifiers*, Mc Cutcheon Divisions, MC Publishing Co. (1985), JP-A-60-76741 (the term "JP-A" as used herein refers to a "published unexamined Japanese patent application"), JP-A-62-172343, JP-A-62-173459 and JP-A-62-215272, for example.

In addition, other antistatic agents may be used together in the present invention, with specific examples including fluorine-containing surfactants or polymers disclosed in JP-A-62-215272, nonionic surfactants disclosed, e.g, in JP-A-60-76742, JP-A-60-80846, JP-A-60-80848, JP-A-60-80839, JP-A-60-76741, and JP-A-58-208743, and conductive polymers or latexes (including nonionic, anionic, cationic and amphoteric ones). Also, there can be used inorganic antistatic agents, such as halides, sulfates, perchlorates, acetates, phosphates, and thiocyanates of ammonium, alkali metals and alkaline earth metals; and conductive tin oxide, zinc oxide or composite oxides obtained by doping these metal oxides with antimony or the like, as disclosed, e.g., in JP-A-57-118242.

As for the binder or the protective colloid which can be used for the emulsion layers and interlayers of the photographic material of the present invention, gelatin is advantageously used. Of course, other hydrophilic colloids can also be used.

Specific examples of hydrophilic colloids which can be used include proteins such as gelatin derivatives, graft copolymers prepared from gelatin and other high polymers, albumin and casein; sugar derivatives such as cellulose derivatives (e.g., hydroxyethyl cellulose, carboxymethyl cellulose, cellulose sulfate), sodium alginate and starch derivatives; and various kinds of synthetic hydrophilic macromolecular substances such as homopolymers or copolymers including polyvinyl alcohol, polyvinyl alcohol partial acetal, poly-N-vinylpyrrolidone, polyacrylic acid, polymethacrylic acid, polyacrylamide, polyvinylimidazole and polyvinylpyrazole.

Gelatins which can be used include not only lime-processed gelatin, but also acid-processed gelatin, hydrolysis products of gelatin, and enzyme-processed gelatin.

Among these binders, the combined use of gelatin with dextran and polyacrylamide is particularly preferred.

In the hydrophilic colloid layers which constitute the photographic material of the present invention, polyols such as trimethylolpropane, pentanediol, butanediol, ethylene glycol, glycerin and sorbitol can be used as a plasticizer.

The silver halide grains in the photographic emulsions to be used in the photographic material of the present invention may have a regular crystal form, such as that of a cube and an octahedron; an irregular crystal form, such as that of a sphere and a plate; or a composite form thereof. Also, they may have a tabular crystal form disclosed in *Research Disclosure,* Vol. 225, No. 22534, pp. 20 to 58, JP-A-58-127921 and JP-A-58-113926. Further, they may be a mixture of various crystal forms of silver halide grains.

In a process of forming silver halide grains and/or allowing the formed silver halide grains to grow, metal ion can be added using at least one salt selected from among cadmium salts, zinc salts, lead salts, thallium salts, iridium salts (including complexes), rhodium salts (including complexes) and iron salts (including complexes) to allow such a metallic element to be present inside the grains or at the surface thereof and, further, reductively sensitized nuclei can be formed inside the grain and/or at the surface thereof by placing the resulting grains in an appropriate reductive atmosphere.

Unnecessary soluble salts may be removed from the silver halide emulsions after the growth of the silver halide grains, or may be left as they are. Removal of such salts can be carried out according to the methods described in *Research Disclosure,* No. 17643, Item II.

As for the distribution of halide compositions in the silver halide grains, it may be uniform throughout, or the interior and the surface of the grains may differ as observed in the core/shell type grains.

The silver halide emulsions may have any kind of grain size distribution. Specifically, they may be broad in grain size distribution (so-called polydisperse emulsions), or emulsions having narrow grain size distributions (so-called monodisperse emulsions) may be used alone or as mixture of several kinds thereof. The terminology "monodisperse emulsion" as used herein refers to such a disperse system that a quotient of the standard deviation of grain sizes by the average grain size may be 0.20 or less. Herein, the grain size is represented by a diameter of each grain in case of cubic silver halide grains, but if the silver halide grains have a crystal form other than a cube then the grain size refers to the diameter of the circle having the same area as the projected area of the grain. Also, a polydisperse emulsion and a monodisperse emulsion may be used in a mixed form.

Moreover, emulsions to be used in the present invention may be a mixture of a light-sensitive silver halide emulsion with an internally fogged silver halide emulsion, or a combination of these emulsions to be coated in separate layers, as disclosed in U.S. Pat. Nos. 2,996,382, 3,397,987 and 3,705,858. Herein, the additional use of the mercapto compounds disclosed in JP-A-61-48832 is advantageous in that generation of fog can be suppressed and the keeping property can be improved, inter alia.

For the purpose of preventing the photographic material of the present invention from generating fog during the preparation, storage or photographic processing, or stabilizing photographic properties thereof, the photographic emulsions can contain a wide variety of compounds. More specifically, compounds which can be added include a number of conventional antifoggants or stabilizers, such as azoles, e.g., benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles and mercaptotetrazoles (especially, 1-phenyl-5-mercaptotetrazole); mercaptopyrimidines; mercaptotriazines; thioketo compounds such as oxazolinethione; and azaindenes such as triazaindenes, tetraazaindenes (especially, 4-hydroxy-substituted (1,3,3a,7)tetraazaindenes) and pentaazaindenes; and number of compounds known as either an antifoggant or a stabilizer, such as benzenethiosulfonic acid, benzenesulfinic acid, benzenesulfonic acid amide, inter alia.

In hydrophilic colloid layers used as constituents in the photographic material of the present invention, conventional polymer latexes, such as homo- or copolymers of alkylacrylates and copolymers of vinylidene chloride, can be included. The polymer latexes may be stabilized in advance with nonionic surface active agents, as disclosed in JP-A-61-230136.

For the purpose of enhancing sensitivity, increasing contrast, or accelerating development, the photographic emulsion layers to constitute the photographic material of the present invention may contain polyalkylene oxides or derivatives thereof, such as their ethers, esters and amines; thioether compounds; thiomorpholines; quaternary ammonium salt compounds; urethane derivatives; urea derivatives; imidazole derivatives; and 3-pyrazolidones, inter alia.

The photographic emulsions to be used in the present invention may be spectrally sensitized with methine dyes or other suitable dyes. Suitable spectral sensitizing dyes which can be used include cyanine dyes, merocyanine dyes, complex cyanine dyes, complex merocyanine dyes, holopolar cyanine dyes, hemicyanine dyes, styryl dyes and hemioxonol dyes. Especially useful dyes are cyanine dyes, merocyanine dyes and complex merocyanine dyes.

A support to be used in the present invention can be provided with an antihalation layer. For this purpose, carbon black or a wide variety of dyes, such as oxonol dyes, azo dyes, arylidene dyes, styryl dyes, anthraquinone dyes, merocyanine dyes, tri-(or di-)allylmethane dyes, for example, can be used therein. In this case they may be used together with a cationic polymer or latex so as not to diffuse from the antihalation layer. These additives are described in *Research Disclosure*, Vol. 176, No. 17643, Item VIII. In addition, magenta dyes disclosed in JP-A-61-285445 may be used for the purpose of improving upon the tone of developed silver. Hydrophilic colloid layers to be employed in the present invention can contain a so-called matting agent, such as colloidal silica, barium strontium sulfate, polymethylmethacrylate and methylmethacrylate-methacrylic acid copolymer, methylmethacrylate-styrenesulfonic acid copolymer disclosed in JP-A-63-216046, and fluorine-containing polymer particles disclosed in JP-A-61-230136, for example.

Photographic emulsion layers and other constituent layers in the photographic material of the present invention may contain inorganic or organic hardeners. For example, aldehydes (e.g., formaldehyde, glyoxal, glutaraldehyde), active vinyl compounds (e.g., 1,3,5-triacryloyl-hexahydro-s-triazine, 1,3-vinylsulfonyl-2-propanol), active halogen-containing compounds (e.g., 2,4-dichloro-6-hydroxy-s-triazine), mucohalogen acids (e.g., mucochloric acid, mucophenoxychloric acid), aziridines, for example, can be used alone or as a combination of two or more thereof. Hardeners which can be preferably used are vinylsulfone compounds represented by the following formula:

$$(CH_2{=}CH{-}SO_2{-}CH_2)_2{-}A$$

wherein A can represent a divalent group, or it may be excluded.

The photographic material of the present invention can contain a developing agent. Suitable examples of a developing agent which can be used include those described in *Research Disclosure,* Vol. 176, page 29, the item "Developing Agents". In particular, hydroquinones and pyrazolidones are preferably used.

In the present invention, couplers which can form yellow, cyan and magenta colors may be used, with specific examples including those described in detail in JP-A-62-215272.

A photographic processing for the photographic material of the present invention may be a processing for forming silver image (black-and-white photographic processing), or a processing for forming color images (color photographic processing). When images are formed in accordance with a reversal process, a black-and-white negative development step is first performed, and then the exposure to white light or the treatment with a bath containing a fogging agent is carried out, followed by color development step. On the other hand, a silver dye bleach process can be used in which dyes are incorporated in advance in a photographic material, the photographic material is subjected to successive exposure and black-and-white development to form a silver image, and the thus formed silver image is used as a bleaching catalyst to bleach the dyes.

The black-and-white photographic processing generally includes a development step, a fixation step and a washing step. When a stop step is carried out after the development step, or when a stabilization step is carried out after the fixation step, the washing step may be omitted. Also, a developing agent or a precursor thereof may be incorporated in the photographic material, wherein the development step is carried out using an alkaline solution alone. Further, a development step using a Lith developer may be employed.

A color photographic processing can be effected in a conventional manner such as described in *Research Disclosure,* No. 17643, pp. 28 and 29, and ibid., No. 18716, p. 615, left to right column. For instance, it includes a color development step, a bleach step, a fixation step, a washing step and, if necessary, a stabilization step. Instead of carrying out a processing with a bleaching bath and a processing with a fixing bath, a bleach-fix step can be performed using a combined bleaching and fixing bath. Further, a bleach step, a fixation step and a bleach-fix step may be combined in any manner desired. Furthermore, a monobath processing can be carried out wherein color development, bleach and fixation steps are effected with a combined developing, bleaching and fixing bath. In combination with the above described steps, a prehardening step, a neutralizing step therefor, a stop-fix step, and a posthardening step, inter alia, may be carried out. A washing step may be interposed between any successive two of the above described steps. Instead of carrying out the color development step in these processings, an activator step may be adopted in which a color developing agent or a precursor thereof is incorporated in advance in a photographic material, and the development step is effected with an activator solution. Also, the activator step can be applied to the monobath step.

A black-and-white developing bath to be used for the black-and-white development step includes those used for conventional black-and-white photographic materials, and can contain various additives added to conventional black-and-white developing baths.

As examples of typical additives, a developing agent such as 1-phenyl-3-pyrazolidone, Metol and hydroquinone, a preservative such as a sulfite, an accelerator comprising alkalis such as sodium hydroxide, sodium carbonate, potassium carbonate and the like, an inorganic or organic inhibitor such as potassium bromide, 2-methylbenzimidazole, methylbenzothiazole and the like, a water softener such as polyphosphate, a surface over development inhibitor comprising a trace amount of iodide and a mercapto compound may be added. A color developing bath used in the color development step is preferably an alkaline aqueous solution containing, as a main component, an aromatic primary amine type color developing agent. As for the color developing agent, p-phenylenediamine compounds are preferably used, though aminophenol compounds also are useful. Typical examples of p-phenylenediamine type color developing agents include 3-methyl-4-amino-N-ethyl-N-β-hydroxyethylaniline, 3-methyl-4-amino-N-ethyl-N-β-methanesulfonamidoethylaniline, and the sulfates of the above cited anilines. Further, the color developing bath may additionally contain pH buffering agents, such as carbonates, borates or phosphates of alkali metals; development inhibitors or antifoggants, such as bromides, iodides, benzimidazoles, benzothiazoles or mercapto compounds; various kinds of preservatives, such as hydroxylamine, diethylhydroxylamine, sulfites, hydrazines, phenylsemicarbazides, triethanolamine, catechol sulfonic acids, and the like; organic solvents, such as ethylene glycol or diethylene glycol; development accelerators such as benzyl alcohol, polyethylene glycol, quaternary ammonium salts or amines; dye forming couplers; competing couplers; fogging agents such as sodium borohydride; auxiliary developers such as 1-phenyl-3-pyrazolidone; viscosity imparting agents and various chelating agents represented by aminopolycarboxylic acids, aminopolyphosphonic acids, alkylphosphonic acids and phosphonocarboxylic acids; a fluorescent brightening agent such as 4,4'-diamino-2,2'-disulfostilbene compounds; various kinds of surfactants such as alkylsulfonic acids, arylsulfonic acids, aliphatic carboxylic acids, aromatic carboxylic acids and the like.

Examples of a bleaching agent which can be used in a bleaching bath or a bleach-fix bath include compounds of polyvalent metals, such as Fe(III), Co(III), Cr(VI), Cu(II), and the like; peroxy acids; quinones; nitro compounds; and the like. More specifically, ferricyanides; dichromates; organic complex salts formed by Fe(III) or Co(III) and aminopolycarboxylic acids, such as ethylenediaminetetraacetic acid, diethylenetriaminepentaacetic acid, cyclohexanediaminetetraacetic acid, methyliminodiacetic acid, 1,3-diaminopropanetetraacetic acid, glycol ether diaminetetraacetic acid, etc., citric acid, tartaric acid, malic acid, and the like; persulfates; hydrobromides; permanganates; nitrobenzenes; for example, are representative of useful bleaching agents.

To the bleach or bleach-fix bath, a rehalogenating agent such as ammonium bromide or ammonium chloride, a pH buffering agent such as ammonium nitrate, a metal corrosion inhibitor such as ammonium sulfate, and other known additives can be added.

As examples of fixers which can be used in a fixing bath or a bleach-fix bath, mention may be made of thiosulfates, thiocyanates, thioether compounds, thioureas, a large amount of iodide, and the like. Of these fixers, ammonium thiosulfate is particularly preferred in respects of solubility and fixing speed. Examples of preservatives suitable for the bleach-fix bath include sulfites, bisulfites, adducts of carbonyl compounds and bisulfites, and sulfinic acid compounds. In the fixing bath, it is desirable for enhancement of stability that aminopolycarboxylic acids or chelating agents of organic phosphonic acid type (preferably, 1-hydroxyethylidene-1,1-diphosphonic acid and N,N,N',N'-ethylenediaminetetraphosphonic acid) be included.

In the fixing bath and the bleach-fix bath, various kinds of fluorescent brightening agents, defoaming agents, surfactants, polyvinylpyrrolidone, methanol, for example, can further be included.

Each processing temperature is, in general, chosen from the range of 10° C. to 65° C., though it may be higher than 65° C. Preferably, each processing is carried out at temperatures of from 25° C. to 45° C.

In various kinds of photographic materials, especially X-ray photographic materials, reduction of development time has been actively pursued. In addition, means for simplifying the photographic processing have been developed. The use of the high molecular weight compounds of the present invention makes it feasible to provide photographic materials which satisfactorily meet the recent requirements of the photographic processing technologies.

This invention will now be illustrated in more detail by reference to the following examples. However, the invention should not be construed as being limited to these examples.

EXAMPLE 1

1-1) Preparation of Base

Vinylidene chloride/itaconic acid (97/3 by mol) copolymer and sodium salt of dichlorohydroxytriazine (0.03 g/m$^2$) were coated on both sides of a polyethylene terephthalate (PET) film, and then subjected to a biaxial stretching treatment at 220° C. to prepare a polyethylene terephthalate support (with a PET thickness of 175 μm, and a vinylidene chloride copolymer layer thickness of 0.7 μm). After one side of the support was submitted to a corona discharge treatment, a solution was coated thereon with a bar, containing the Conductive Agent Compound of Sample No. 1-2 set forth in Table 1 and a sensitizer (10 mg/m$^2$ of 3,3-carbonyl-bis(7-diethylaminocoumarin) in ethyl acetate. Then, the coat was dried at 140° C., and further exposed to a 5 kw mercury lamp for 60 seconds to prepare an undercoat. The thus formed undercoat was submitted to a corona discharge treatment, and thereon was coated a mixture of gelatin (0.2 g/m$^2$), sodium α-sulfodihexylsuccinate (0.002 g/m$^2$), poly(styrene/divinylbenzene) (polymerizing ratio: 98:2, average particle size: 2.0 μm, coverage: 0.02 g/m$^2$) and 1,3-divinylsulfonyl-2-propanol (0.005 g/m$^2$) to prepare an undercoat protecting layer. In addition, on the other side of the support was provided the same undercoat protecting layer alone. Thus, the base for the present invention, which had finished the undercoating, was obtained. This base preparation procedure was repeated for the Conductive Agent Compounds of each of Sample Nos. 1-3 to 1-6 in Table 1.

As for Control Sample 1-1, no undercoat was provided, but the same undercoat protecting layer as described above was provided on both sides of the polyethylene terephthalate support.

On the other hand, Comparative Samples 1-7 and 1-11 were prepared as follows: After the formation of the foregoing vinylidene chloride copolymer layer and the subsequent corona discharge treatment on one side, an undercoat was formed by adding a comparative compound set forth in Table 1 to an aqueous solution containing gelatin (0.06 g/m$^2$), sodium 2,4-dichloro-6-hydroxytriazine (0.005 g/m$^2$) and p-octylphenoxypolyoxyethylene ether (polymerization degree: 10, coverage: 0.003 g/m$^2$), coating the resulting solution, and then drying the coat at 140° C. On the thus formed undercoat, the same undercoat protecting layer as used for the above samples of the present invention was provided. On the other side of the support, the same undercoat protecting layer alone was formed.

Further, Comparative Samples 1-8, 1-9 and 1-10 were prepared in the same manner as the samples of the present invention (e.g., Sample No. 1-2).

1-2) Constitution of Dyed Layer

Preparation of Microcrystalline Dye Dispersion

The dye illustrated below was processed with a ball mill in the following manner.

Water (21.7 ml) and a 6.7% aqueous solution of the surfactant Triton X-200® (2.65 g), a sodium salt of alkylarylpolyether sulfonate produced by Rohm & Haas, were placed in a 60 ml bottle with a screw cap. Thereto, 1.00 g of the dye illustrated below and 40 ml of zirconium oxide beads (diameter: 2 mm) were further added. The bottle with the cap screwed up tightly was set inside the mill, and the content was ground to fine particles over a period of 4 days. Thereafter, the bottle was taken out, and the content was added to a 12.5% aqueous solution of gelatin (8.0 g). The resulting mixture was placed in a roll mill for 10 minutes to diminish bubbles, and then the ZrO beads were removed therefrom by filtration.

Dye

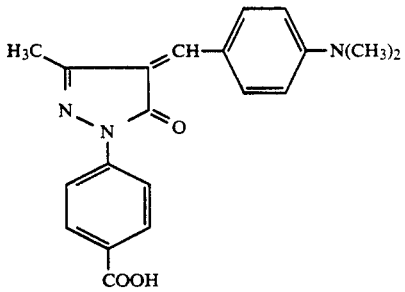

Coating of Dye Dispersion

A surfactant (sodium p-octylphenylethoxyethoxy ethanesulfonate) and a hardener (bis(vinylsulfonylmethyl)ether) were added to the above described dye-gelatin fusion. The resulting fusion was coated on the both sides of the foregoing base so as to have a dye coverage of 0.08 g/m$^2$, a gelatin coverage of 0.4 g/m$^2$, a surfactant coverage of 0.026 g/m2 and a hardener coverage of 0.016 g/m$^2$.

1-3) Constitution of Emulsion Layer 30 g of gelatin, 5 g of potassium bromide and 0.05 g of potassium iodide were added to 1 liter of water placed in a vessel thermostated at 75° C. Thereto, an aqueous silver nitrate (5 g as silver nitrate) and a water solution of potassium bromide in which 0.73 g of potassium iodide was contained were added over a 1 minute period with stirring in accordance with a double jet method. Thereafter, an aqueous silver nitrate (145 g as silver nitrate) and an aqueous potassium bromide were further added using the double jet method, wherein a rate of flow of each solution added was increased acceleratedly so that the flow rate at the end of addition might become 8 times the flow rate at the beginning of addition. Thereafter, 0.37 g of an aqueous potassium iodide was further added.

After the end of addition, soluble salts were removed at 35° C. using a flocculation method. Then, the resulting emulsion was heated up to 40° C., and thereto was supplementally added 60 g of gelatin, followed by adjustment of pH to 6.5. A temperature of the emulsion was raised to 56° C., and then 650 mg of sodium salt of anhydro-5,6'-dichloro-9-ethyl-3,3'-di(3-sulfopropyl)oxacarbocyanine hydroxide was added as a sensitizing dye. Subsequently, the resulting emulsion was chemically sensitized with a combination of gold and sulfur sensitizers. The thus obtained emulsion grains were hexagonal tablets in shape, and had a diameter of 0.85 μm on a basis of projected area, and an average thickness of 0.158 μm.

To this emulsion were further added a mixture of 4-hydroxy-6-methyl-1,3,3a,7-tetraazaindene and 2,6-bis(hydroxyamino)-4-diethylamino-1,3,5-triazine as a stabilizer, and trimethylolpropane.

In addition, the compound illustrated below (350 mg/m$^2$) was added:

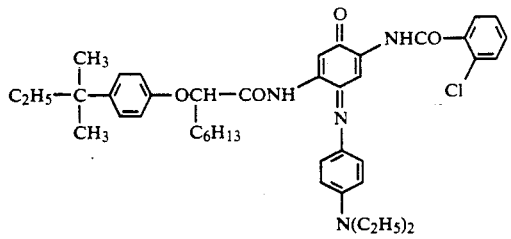

Further were added, as coating aids, sodium p-octylphenoxyethylethanesulfonate (0.01 g/m$^2$) and dodecylbenzenesulfonate (0.005 g/m$^2$), and furthermore, as thickeners, poly(potassium-p-vinylbenzenesulfonate) (0.03 g/m$^2$), polymer latex (ethylacrylate/methacrylic acid (97/3) copolymer particles (average diameter: 0.1 μm) to which polyoxyethylene (polymerization degree: 10) polyoxyglyceryl (polymerization degree: 3) dodecyl ether was adsorbed (in a proportion of 3 wt. % to the particles)) (0.4 g/m$^2$), sodium polyacrylate (with a molecular weight of 200,000) (0.1 g/m$^2$), 1,2-bis(vinylsulfonylacetamido)ethane (0.04 g/m$^2$) and trimethylol.

| 1-4) Composition of Protective Layer | |
|---|---|
| Gelatin | 1.2 g/m$^2$ |
| Polyacrylamide (molecular weight: 45,000) | 0.2 g/m$^2$ |
| Dextran (molecular weight: 38,000) | 0.2 g/m$^2$ |
| Sodium Polyacrylate | 0.02 g/m$^2$ |
| Sodium Polystyrenesulfonate | 0.01 g/m$^2$ |
| Colloidal Silica (grain size: 0.02 μm) | 0.04 g/m$^2$ |
| Polyoxyethylene (polymerization degree: 10) Cetyl Ether | 0.02 g/m$^2$ |
| Polyoxyethylene (polymerization degree: 10)-Polyglyceryl (polymerization degree: 3) p-Octylphenyl Ether | 0.02 g/m$^2$ |
| $C_8H_{17}SO_2N(C_3H_7)(CH_2CH_2O)_4(CH_2)_4SO_3Na$ | 0.001 g/m$^2$ |
| $C_9F_{17}O-C_6H_4-SO_2NH(CH_2)_2\oplus N(CH_3)_3.I\ominus$ | 0.0005 g/m$^2$ |
| $C_9F_{19}CONH(CH_2)_3\oplus N(CH_3)_2-CH_2COO\ominus$ | 0.001 g/m$^2$ |
| $C_8F_{17}SO_2N(C_3H_7)(CH_2CH_2O)_{10}(CH_2CH(OH)CH_2O)_3H$ | 0.005 g/m$^2$ |
| $C_9H_{19}-C_6H_4-O(CH_2CH(OH)CH_2O)_3(CH_2)_4SO_3K$ | 0.01 g/m$^2$ |
| Potassium Nitrate | 0.05 g/m$^2$ |
| Sodium p-t-Octylphenoxyethoxyethoxyethanesulfonate | 0.02 g/m$^2$ |
| 4-Hydroxy-6-methyl-1,3,3a,7-tetraazaindene | 0.04 g/m$^2$ |
| Cetyl Palmitate (dispersed in sodium dodecylbenzenesulfonate, with a particle size of 0.11 μm) | 0.005 g/m$^2$ |
| Dimethyl Siloxane (dispersed in sodium dioctyl-α-sulfosuccinate, with a particle size of 0.12 μm) | 0.005 g/m$^2$ |
| Liquid Paraffin (dispersed in sodium dioctyl-α-sulfosuccinate, with a particle size of 0.11 μm) | 0.005 g/m$^2$ |

-continued

| 1-4) Composition of Protective Layer | |
|---|---|
| Fine Particles of Polymethylmethacrylate (average size: 3.8 μm, proportion of particles having their sizes in the range of 4.8 to 2.8 μm: at least 80%) | 0.04 g/m² |
| Fine Particles of Polystyrene (average particle size: 0.6 μm) | 0.1 g/m² |

As for the above described emulsion and protective layers, each coating solution was prepared so as to have a gelatin concentration of 4 wt. %, which was adopted as the standard formula.

The coating solution for the emulsion layer was applied to both sides of the base prepared in the manner described in procedure 1-1) above at a silver coverage of 1.9 g/m² per each side. As for the order of arrangement for the constituent layers according to their distances from the support, the dyed layer, the emulsion layer and the protective layer were coated in that order, respectively, on each side of the support.

The samples prepared so as to have a conductive undercoat as shown in Table 1 were evaluated. The developer, the fixer, and the photographic processing employed are described below.

| Concentrated Liquid Developer: | |
|---|---|
| Potassium Hydroxide | 56.6 g |
| Sodium Sulfite | 200 g |
| Diethylenetriaminepentaacetic Acid | 6.7 g |
| Potassium Carbonate | 16.7 g |
| Boric Acid | 10 g |
| Hydroquinone | 83.3 g |
| Diethylene Glycol | 40 g |
| 4-Hydroxymethyl-4-methyl-1-phenyl-3-pyrazolidone | 11.0 g |
| 5-Methylbenzotriazole | 2 g |
| Water to make | 3 liters |
| (The pH was adjusted to 10.60.) | |
| Concentrated Liquid Fixer: | |
| Ammonium Thiosulfate | 560 g |
| Sodium Sulfite | 60 g |
| Disodium Ethylenediaminetetraacetate Dihydrate | 0.10 g |
| Sodium Hydroxide | 24 g |
| Water to make | 1 liter |
| (The pH was adjusted to 5.10 using acetic acid.) | |

| Processing Step | Temperature (°C.) | Processing Time (sec) |
|---|---|---|
| Development | 35 | 10.5 |
| Fixation | 35 | 9 |
| Washing | 20 | 7.5 |
| Drying | 50 | |

A dry-to-dry processing time was 45 seconds.

When the photographic processing was started, the tanks were filled with the following processing solutions, respectively.

Developing Tank (6.5 Liters)

333 ml of the above described concentrated liquid developer, 667 ml of water, and 10 ml of starter containing 2 g of potassium bromide and 1.8 g of acetic acid were placed, and the pH was adjusted to 10.15.

Fixing Tank (6.5 Liters)

250 ml of the above described concentrated liquid fixer and 750 ml of water were placed.

(1) Static Mark Test

In order to examine the extent of static mark caused by friction with other materials, each of the unexposed sample films was allowed to stand for 2 hours in the atmosphere of 25° C., 10% RH for conditioning its moisture content, and then two pieces of each sample were rubbed with a urethane rubber roller and a nylon roller, respectively, in a dark room air conditioned at 25° C. and 10% RH, and further subjected to the above described photographic processing.

Evaluation of the extent of static mark caused as shown in Table 1 was made as classified into the following four grades.

A: Generation of static mark was not observed at all.

B: Generation of static mark was somewhat observed.

C: Generation of static mark was considerably observed.

D: Generation of static mark was observed over substantially the entire surface.

(2) Dust Adhesion Test

Each sample piece (20 cm×20 cm) was rubbed with gauze under the condition of 25° C., 10% RH, and the adhesiveness of cigarette ash thereto was examined. The evaluation was made classifying into the following four grades.

A: Dust adhesion was not observed at all.

B: Dust adhesion was somewhat observed.

C: Dust adhesion was considerably observed.

D: Dust adhesion was extremely observed.

(3) Adhesiveness Test

After the finished samples were allowed to stand for 2 weeks in the atmosphere of 25° C., 50% RH, their adhesiveness was tested in the following ways. The faces tested therein were those on the antistatic layer's side.

(a) Adhesiveness Test of Dry Films

On each face to be tested, 7 lineal cuts in every two directions of length and breadth were made at regular intervals of 5 mm, resulting in the formation of 36 squares. Thereto, an adhesive tape (e.g., Nitto tape, produced by Nitto Electric Industrial Co., Ltd.) was applied, and peeled off quickly in the direction pointing 180° away. When more than 90% of the tape applied area was left unpeeled in the above described procedure, the sample was accorded the grade A. On the other hand, when the unpeeled area was 60% or more the grade B was given, and when it is less than 60% the grade C was given. The adhesion strength adequate for practical use as a photographic material corresponded to only those belonging to the grade A in the foregoing three grade evaluation.

(b) Adhesiveness Test of Wet Films

In each of the steps, development, fixation and washing, a cross was scratched on the surface of the film with a stencil pen inside the processing bath, and rubbed hard five times with a finger tip. The adhesiveness was evaluated by the maximal width of the part delaminated along the cross scratch.

When the delamination was not extended beyond the scratch mark, the grade A was accorded, while the grade B was given when the maximal width of the delaminated part is 5 mm or less. Further, the grade C was given to other cases where the maximum width of the delaminated part is more than 5 mm. The adhesion strength adequate for practical use as a photographic material corresponded to those belonging to the grades A and B, preferably the grade A, in the foregoing three grade evaluation.

(4) Evaluation of Fixer Pollution 500 sheets of each sample measuring 25 cm by 30 cm in size, which had been exposed to infrared rays so as to provide a density of 1.5 when measured with a Macbeth densitometer, were processed with freshly prepared developer and fixer. The resulting fixer was examined for an insoluble material suspended therein, and evaluated in four grades defined below.

Therein, the developer and the fixer were replenished in amounts of 50 ml/sheet and 60 ml/sheet, respectively.

A: A suspended material was not observed at all.

B: A suspended material was observed in a slight quantity.

C: A suspended material was observed in a significant quantity.

D: A suspended material was observed in an extremely large quantity.

TABLE 1

| Sample No. | Conductive Undercoat Conductive Agent ($g/m^2$) | Static Mark | | Dust Adhesion | | Fixer Pollution | Adhesion | | |
|---|---|---|---|---|---|---|---|---|---|
| | | Rubber | Urethane | Before Treatment | After Treatment | | Dry film | Wet film | |
| 1-1 (Control) | None | A | C | C | D | A | A | A | |
| 1-2 (Invention) | Compound P-1 (0.02) | A | A | A | A | A-B | A | B | |
| 1-3 (Invention) | Compound P-4 (0.02) | A | A | B | B | A | A | B | |
| 1-4 (Invention) | Compound P-12 (0.02) | A | A | A | A | A | A | A | |
| 1-5 (Invention) | Compound P-19 (0.02) | A | A | A | A | A-B | B | A | |
| 1-6 (Invention) | Compound P-25 (0.02) | A | A | A | A | A | A | A | |
| 1-7 (Comparison) | $SnO_2$/Pb (80/20) Particle (particle size: 0.15 μm) (0.02) | A | A | A | A | C | B | B | |
| 1-8 (Comparison) | Comparative Compound 1 (0.02) | A | A | B | C | C | C | C | Poor Surface State |
| 1-9 (Comparison) | Comparative Compound 2 (0.02) | A | B | B | D | D | C | C | |
| 1-10 (Comparison) | Comparative Compound 3 (0.02) | A | A | B | C | C | B | C | Poor Surface State |
| 1-11 (Comparison) | Sodium Polystyrenesulfonate (0.02) | B | C | B | D | D | C | C | |

Comparative Compound 1

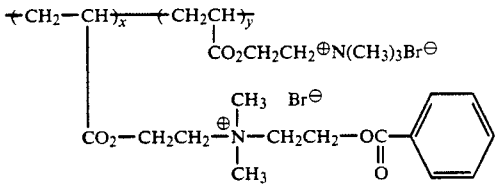

x/y = 20/80

Comparative Compound 2

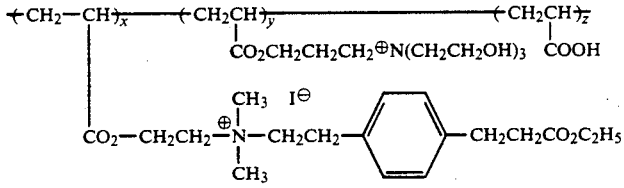

x/y/z = 20/65/5

Comparative Compound 3

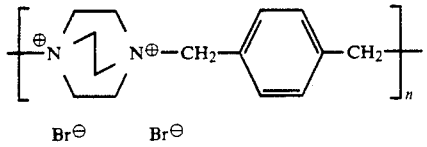

As can be seen from the data of Table 1, Control Sample 1-1, which did not contain any high molecular weight compound of the present invention, was markedly inferior in static mark generation and dust adhesion. On the other hand, Samples 1-2 to 1-6, in which the high molecular weight compounds of the present invention were used, succeeded in solving the problems of dust adhesion and fixer pollution, and got high grades in the rest of the properties evaluated. In contrast, Comparative Sample 1-7 caused significant fixer pollution and deterioration of adhesiveness. Also, Comparative Samples 1-8 to 1-11, in which conventional conductive polymers were used, suffered from the generation of static mark, the aggravation of dust adhesion after processing, the pollution of the fixer, the lowering of adhesiveness, and the deterioration of the surface state of the coat. The properties of Comparative Samples 1-8 to 1-11, taken as a whole, are shown to be inferior to Samples 1-2 to 1-6 of the present invention.

Moreover, Comparative Sample 1-7 was inferior to other samples in transparency as measured according to ASTM D-1003.

Furthermore, it was observed that the control sample and the samples of the present invention 1-2 to 1-6 produced excellent images.

EXAMPLE 2

2-1) Formulation of Silver Halide Emulsion Layer

To an aqueous gelatin solution kept at 50° C., an aqueous solution of silver nitrate and an aqueous solution of a mixture of sodium chloride with potassium bromide were simultaneously added at a constant speed over a 30 minute period in the presence of $2\times10^{-5}$ mol/mol Ag of rhodium chloride to prepare a monodisperse silver chlorobromide emulsion having an average grain size of 0.2 μm (chloride content: 95 mol %).

From this emulsion were removed soluble salts using a flocculation method. Thereto, 1 mg/mol Ag of thiourea dioxide and 0.6 mg of chloroauric acid were added at 65° C., and thereby was ripened the emulsion until the highest ability was imparted thereto, thus achieving the fogging.

To the thus prepared emulsion, the following compounds were added:

| | |
|---|---|
| 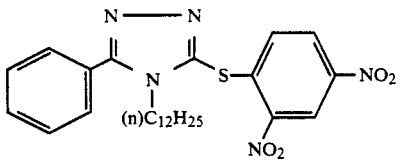 | $2\times10^{-2}$ mol/mol Ag |
| 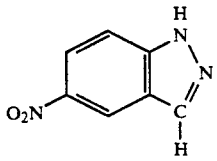 | $1\times10^{-3}$ mol/mol Ag |

-continued

| | |
|---|---|
| 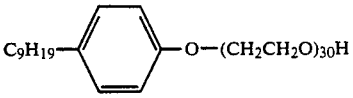 | $4\times10^{-4}$ mol/mol Ag |
| KBr | 20 mg/m$^2$ |
| Sodium Polystyrenesulfonate | 40 mg/m$^2$ |
| Sodium 2,6-Dichloro-6-hydroxy-1,3,5-triazine | 30 mg/m$^2$ |

The resulting composition was coated at a coverage of 3.5 g/m$^2$ based on silver.

2-2) Formulation of Emulsion Protecting Layer

The following compounds were further added to the coating composition prepared for the protective layer (1-4) in Example 1. The resulting composition was coated at a coverage of 1.5 g/m$^2$ based on gelatin.

| | |
|---|---|
| Sodium Dodecylbenzenesulfonate | 0.05 g/m$^2$ |
| Sodium Acetate | 0.03 g/m$^2$ |
| 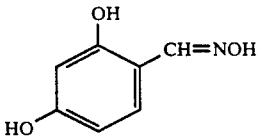 | 0.02 g/m$^2$ |
| 5-Nitroindazole | 0.015 g/m$^2$ |
| 1,3-Divinylsulfonyl-2-propanol | 0.05 g/m$^2$ |
| Potassium N-Perfluorooctanesulfonyl-N-propylglycine | 0.002 g/m$^2$ |
| Ethyl Acrylate Latex (average particle size: 0.1 μm) | 0.2 g/m$^2$ |
| 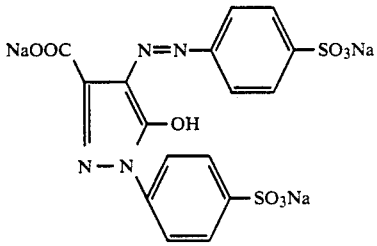 | 0.1 g/m$^2$ |

2-3) Formulation of Undercoat for Backing Layer

| | |
|---|---|
| Gelatin | 0.01 g/m$^2$ |
| Polyethyl Acrylate Latex (particle size: 0.06 μm) | 0.005 g/m$^2$ |
| 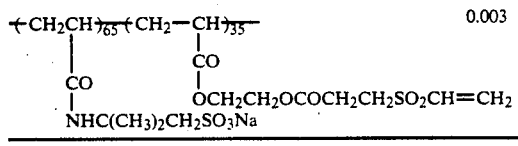 | 0.003 g/m$^2$ |

2-4) Formulation of Backing Layer

| | |
|---|---|
| Gelatin | 2.5 g/m$^2$ |

-continued

| | |
|---|---|
| 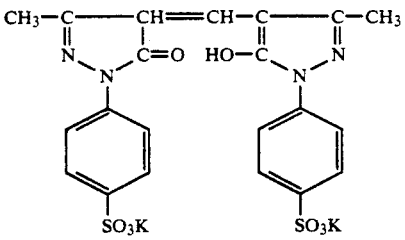 | 30 mg/m$^2$ |
| 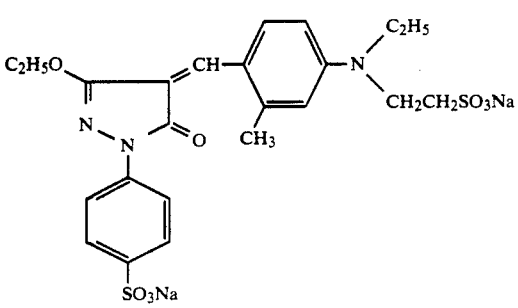 | 140 mg/m$^2$ |
| 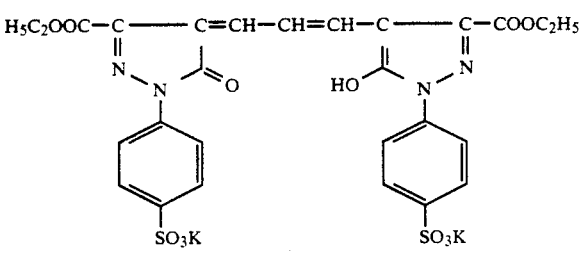 | 40 mg/m$^2$ |
| 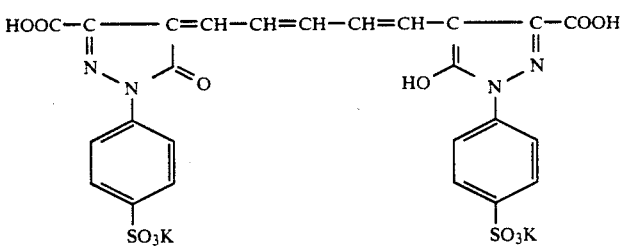 | 80 mg/m$^2$ |
| 1,3-Divinylsulfonyl-2-propanol | 150 mg/m$^2$ |
| Ethyl Acrylate Latex (average particle size: 0.1 μm) | 900 mg/m$^2$ |
| Sodium Dihexyl-α-sulfosuccinate | 35 mg/m$^2$ |
| Sodium Dodecylbenzenesulfonate | 35 mg/m$^2$ |

2-5) Formulation of Back Protecting Layer

A back protecting layer is formed in the same manner as in Example 1. Herein, the gelatin coverage was controlled to 1.0 g/m$^2$.

Samples each was prepared as follows: Each of the compounds set forth in Table 2 and a sensitizer (10 g/m$^2$ of 2-(p-chlorobenzoyl)naphthothiazole) were applied to the same PET base as used in Example 1 and processed in the same manner as in Example 1 to form an undercoat. On the side of the undercoat, the undercoat for the backing layer, the backing layer and the back protecting layer were simultaneously coated in that order, and on the other side of the PET base were coated the emulsion layer and the emulsion protecting layer. Evaluation results of the thus prepared samples are shown in Table 2.

TABLE 2

| Sample No. | Conductive Undercoat Conductive Agent | (g/m$^2$) | Static Mark Rubber | Static Mark Urethane | Dust Adhesion Before Treatment | Dust Adhesion After Treatment | Fixer Pollution | Adhesion Dry film | Adhesion Wet film |
|---|---|---|---|---|---|---|---|---|---|
| 2-1 (Control) | None | | A | C | C | D | A | A | A |
| 2-2 (Invention) | Compound P-2 | (0.02) | A | A | A | A | A | A | B |
| 2-3 (Invention) | Compound P-3 | (0.02) | A | A | A | A | A | A | A |

TABLE 2-continued

| Sample No. | Conductive Undercoat Conductive Agent | (g/m²) | Static Mark Rubber | Static Mark Urethane | Dust Adhesion Before Treatment | Dust Adhesion After Treatment | Fixer Pollution | Adhesion Dry film | Adhesion Wet film | |
|---|---|---|---|---|---|---|---|---|---|---|
| 2-4 (Invention) | Compound P-10 | (0.02) | A | A | A | A | A | A | A | |
| 2-5 (Invention) | Compound P-13 | (0.02) | A | A | A | A | A-B | A | A | |
| 2-6 (Invention) | Compound P-24 | (0.02) | A | A | A | A | A-B | B | A | |
| 2-7 (Comparison) | $SnO_2$/Pb (80/20) Particle (particle size: 0.15 μm) | (0.02) | A | A | A | A | C | B | C | |
| 2-8 (Comparison) | Comparative Compound 1 | (0.02) | A | A | B | D | D | C | C | Poor Surface State |
| 2-9 (Comparison) | Comparative Compound 2 | (0.02) | A | B | B | D | C | C | C | |
| 2-10 (Comparison) | Comparative Compound 3 | (0.02) | A | A | B | D | C | C | C | Poor Surface State |
| 2-11 (Comparison) | Sodium Polystyrenesulfonate | (0.02) | B | C | C | D | D | C | C | |

Samples 2-2 to 2-6 prepared using the high molecular weight compounds of the present invention, as can be seen from Table 2, were rated high in respect to static mark generation, dust adhesion and fixer pollution were completely or almost completely prevented, and were excellent in coating facility and adhesiveness, as well.

On the other hand, not all the requirements, including prevention of static mark, dust adhesion and fixer pollution, and acquisition of excellent coating facility and adhesiveness, were satisfied by Control Sample 2-1 and Samples 2-7 to 2-11, in which comparative conductive agents for the sake of comparison were used.

EXAMPLE 3

Color photographic negative film Samples 3-1 to 3-11 were prepared in the same manner as in Example 2, except that said emulsion layer comprising tabular silver halide grains was replaced by the first to the fourteenth constituent layers of the light-sensitive layer of Sample 202 prepared in Example 3 of JP-A-63-264740, and evaluated by the same experiments as in Example 2. Therein, the processings were carried out in accordance with those in Example 3 of JP-A-63-264740.

Samples 3-2 to 3-6 of the present invention satisfied all the requirements in respects of static mark generation, dust adhesion, fixer pollution, coating facility and adhesiveness.

On the other hand, not all the above described requirements were able to be fulfilled by Comparative Samples 3-7 to 3-11 and Control Sample 3-1.

EXAMPLE 4

On one side of a cellulose triacetate support, the coating composition for the light-sensitive layer of Sample 104 prepared in Example 2 of JP-A-63-264740 was coated. On the other side of the support, the following backing layers were provided.

First Backing Layer

The same present compound and the same sensitizer as used in Example 1, and diethylene glycol (10 mg/m²) were dissolved in a solvent mixture of acetone, methanol and water, coated at the same coverage as in Example 1, and then exposed to a 5 kw mercury lamp for 60 seconds in a similar manner as in Example 1.

Second Backing Layer

Diacetyl cellulose (200 mg/m²), stearic acid (10 mg/m²), cetyl stearate (20 mg/m²) and silica particles with a size of 0.3 μm (30 mg/m²) were dissolved in a solvent mixture of acetone, methanol and water, and coated.

The processings were carried out in the same manner as in Example 2 of JP-A-63-264740.

Samples 4-1 to 4-11 obtained were evaluated in the same way as in Example 1.

The present Samples 4-2 to 4-6 satisfied all the requirements in respects of static mark generation, dust adhesion, fixer pollution, coating facility and adhesiveness, and produced excellent image.

On the other hand, not all the above described requirements were able to be fulfilled by Control Sample 4-1 and Comparative Samples 4-7 to 4-11.

EXAMPLE 5

Synthesis of Methylmethacrylate/Ethylacrylate/Acrylic Acid Copolymer 1.5 g of a compound having the following structural formula:

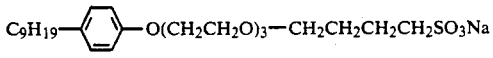

was weighed out, placed in a 1 liter three necked flask equipped with a stirring device and a reflux condensor, and dissolved in 300 ml of water. The reaction system was then heated up to 75° C. in a stream of nitrogen, and stirred at 200 rpm. Thereto, 40 g of 3% aqueous potassium persulfate, and then a mixture of 150 g of methylmethacrylate, 87.5 g of ethylacrylate and 12.5 g of acrylic acid was added dropwise over a period of 3 hours. A 10 g portion of 3% aqueous potassium persulfate was added a total of 6 times every 30 minutes after the beginning of the dropwise addition. After completion of the addition of the monomer mixture, the reaction system was kept at 75° C. for additional two hours to yield an aqueous dispersion of the copolymer with an average molecular weight of 250,000. This aqueous dispersion was neutralized with 10% aqueous potassium hydroxide to be adjusted to pH 7.0.

To the aqueous dispersion of the copolymer were added sodium salt of 2,4-dichloro-6-hydroxy-1,3,5-triazine in a proportion of 4 wt. % to the copolymer, and further fine particles of polystyrene with an average particle size of 2 μm in such an amount as to have a coverage of 1.0 mg/m$^2$, thus preparing a coating composition for the first undercoat.

A biaxially stretched polyethylene terephthalate film having a thickness of 100 μm and a width of 30 cm was subjected to a corona discharge treatment under the following condition: A film traveling speed was 30 m/min, a gap between the corona discharge electrode and the film was 1.8 mm, and an electric power supplied was 200 watts. Upon both sides of the polyethylene terephthalate film having received the corona discharge treatment, the aqueous dispersion of the copolymer prepared in the above described process was coated in a dry thickness of 0.1 μm, and dried at 185° C. These layers each was called the first undercoat. The resulting film was further subjected to a corona discharge treatment under the condition that a film traveling speed was 30 m/min, a gap between the corona discharge electrode and the film was 1.8 mm and an electric power supplied was 120 watts. On both sides of the thus treated film, an aqueous dispersion of vinylidene chloride/methylmethacrylate/methylacrylate/acrylonitrile/acrylic acid (90/4.5/4/1/0.5 by wt. %) copolymer was coated in a dry thickness of 0.75 μm, and dried at 120° C. One side of the second undercoat constituted by the foregoing vinylidene chloride copolymer was subjected to a corona discharge treatment under the condition that a film traveling speed was 30 m/min, a gap between the corona discharge electrode and the film was 1.8 mm, and an electric power supplied was 250 watts. On the thus treated side of the second undercoat, a composition of formulation (1) described below was coated at a coverage of 20 ml/m$^2$, and dried at 170° C. to form the third undercoat on which an emulsion was to be coated.

Then, on the other side of the second undercoat were provided the same conductive undercoat and the same undercoat protecting layer as described in Example 1 to complete the undercoat on the back side.

Subsequently, a silver halide emulsion of the following formulation (2) was coated on the undercoat provided on the emulsion side of the support, and thereon was further coated an emulsion protecting layer of the following formulation (3).

Furthermore, on the undercoat provided on the back side of the support were coated a backing layer of the following formulation (4) and a back protecting layer of the formulation (5) in this order. Thus, Samples 5-1 to 5-11 were prepared.

(1) Formulation of Third Undercoat

| | |
|---|---|
| Gelatin | 1.0 wt % |
| Methyl Cellulose | 0.05 wt % |
| Surfactant ($C_{12}H_{25}O(CH_2CH_2O)_{10}H$) | 0.03 wt % |
| Water to make | 100.0 wt % |

(2) Formulation of Silver Halide Emulsion Layer

To an aqueous gelatin solution kept at 50° C., an aqueous solution of silver nitrate and an aqueous solution of a mixture of sodium chloride with potassium bromide were simultaneously added at a constant speed over a 30 minute period in the presence of $2\times10^{-5}$ mol/mol Ag of rhodium chloride to prepare a monodisperse silver chlorobromide emulsion having an average grain size of 0 2 μm (chloride content: 95 mol %).

From this emulsion were removed soluble salts using a flocculation method. Thereto, 1 mg/mol Ag of thiourea dioxide and 0.6 mg of chloroauric acid were added at 65° C., and thereby ripened to emulsion until the highest ability was imparted thereto, thus achieving the fogging.

To the thus prepared emulsion, the following compounds were added:

| | |
|---|---|
| 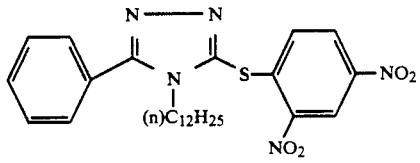 | $2\times10^{-2}$ mol/mol Ag |
| 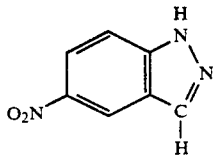 | $1\times10^{-3}$ mol/mol Ag |
| 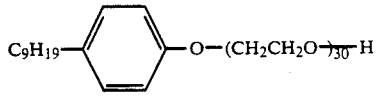 | $4\times10^{-4}$ mol/mol Ag |
| KBr | 20 mg/m$^2$ |
| Sodium Polystyrenesulfonate | 40 mg/m$^2$ |
| Sodium 2,4-Dichloro-6-hydroxy-1,3,5-triazine | 30 mg/m$^2$ |

The resulting composition was coated at a coverage of 3.5 g/m$^2$ on silver.

(3) Formulation of Emulsion Protecting Layer

| | |
|---|---|
| Gelatin | 1.5 g/m$^2$ |
| Fine Particles of $SiO_2$ (average size: 4 μm) | 50 mg/m$^2$ |
| Sodium Dodecylbenzenesulfonate | 50 mg/m$^2$ |
| 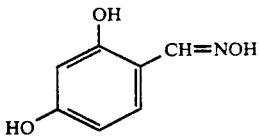 | 20 mg/m$^2$ |
| 5-Nitroindazole | 15 mg/m$^2$ |
| 1,3-Divinylsulfonyl-2-propanol | 50 mg/m$^2$ |
| Potassium N-Perfluorooctanesulfonyl-N-propylglycine | 2 mg/m$^2$ |
| Ethyl Acrylate Latex (average particle size: 0.1 μm) | 300 mg/m$^2$ |
| 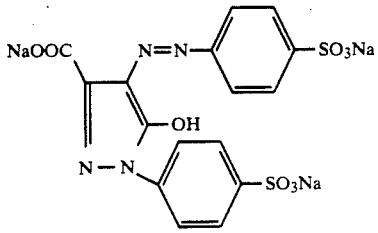 | 100 mg/m$^2$ |

(4) Formulation of Backing Layer

| | |
|---|---|
| Gelatin | 2.5 g/m$^2$ |
| 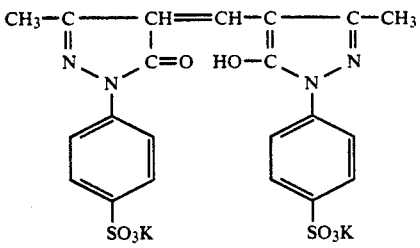 | 30 mg/m$^2$ |
| 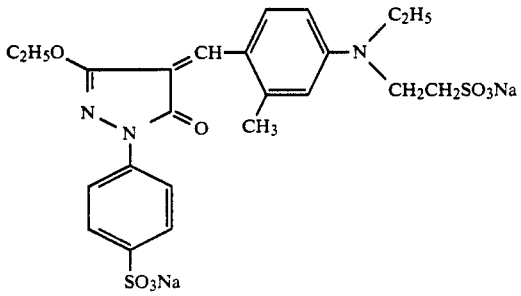 | 140 mg/m$^2$ |
| 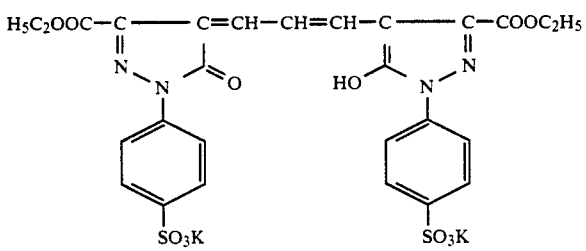 | 40 mg/m$^2$ |
| 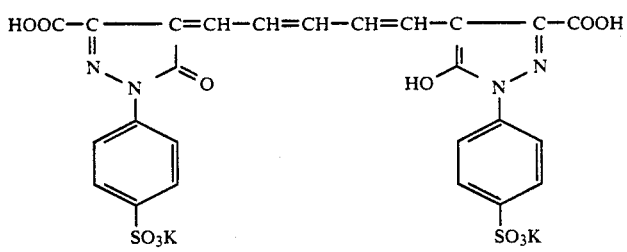 | 80 mg/m$^2$ |
| 1,3-Divinylsulfonyl-2-propanol | 150 mg/m$^2$ |
| Ethyl Acrylate Latex (average particle size: 0.1 μm) | 900 mg/m$^2$ |
| Sodium Dihexyl-α-sulfosuccinate | 35 mg/m$^2$ |
| Sodium Dodecylbenzenesulfonate | 35 mg/m$^2$ |

(5) Formulation of Back Protecting Layer

| | |
|---|---|
| Gelatin | 0.8 g/m$^2$ |
| Fine Particles of Polymethylmethacrylate (average size: 3 μm) | 20 mg/m$^2$ |
| Sodium Dihexyl-α-sulfosuccinate | 10 mg/m$^2$ |
| Sodium Dodecylbenzenesulfonate | 10 mg/m$^2$ |
| Sodium Acetate | 40 mg/m$^2$ |

The photographic processing was carried out using an automatic developing machine, FG-660F, produced by Fuji Photo Film Co., Ltd., and the developer and the fixer used were GRD-1 and GRF-1, respectively, produced by Fuji Photo Film Co., Ltd. The processing condition was 38° C., 20 sec., and the drying temperature was 45° C.

Samples 5-1 to 5-11 prepared were each evaluated in the same way as in Example 1.

Samples 5-2 to 5-6 of the present invention satisfied all the requirements in respects of static mark generation, dust adhesion, fixer pollution, coating facility and adhesiveness, and the images produced therein were excellent.

On the other hand, not all the above described requirements were able to be fulfilled by Control Sample 5-1 and Comparative Samples 5-7 to 5-11.

Thus, the present invention has been demonstrated to be superior to conventional photographic materials.

While the invention has been described in detail and with reference to specific embodiments thereof, it will be apparent to one skilled in the art that various changes and modifications can be made therein without departing from the spirit and scope thereof.

What is claimed is:

1. A silver halide photographic element which comprises a support having thereon one or more constituent layers including at least one silver halide emulsion layer, wherein said constituent layers comprise at least one layer selected from the group consisting of a subbing layer and a backing layer which is formed by (a) coating a composition which contains a high molecular weight compound comprising at least one repeating unit selected from each of the repeating units represented by the following formulae (I) and (V), the repeating unit represented by formula (I) being contained in a fraction of rom 2 to 60 mol % of the high molecular weight compound, the repeating unit represented by formula (V) being contained in a fraction of from greater than 0 to 98 mol % of the high molecular weight compound, and the high molecular weight compound being contained in an amount of from 0.0001 to 2.0 g/m$^2$ of the photographic element, and then (b) making the composition undergo a cross-linking reaction through irradiation or heating:

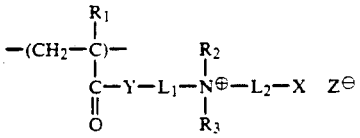

(I)

wherein $R_1$ represents a hydrogen atom or an alkyl group; $R_2$ and $R_3$ each represents an alkyl group;

$L_1$ and $L_2$ each represents a divalent linking group represented by formula (II):

$$-(L_3)_a-(A-L_4)_b-(B-L_5)_c-(D)_d- \quad \text{(II)}$$

wherein $L_3$ and $L_5$ each represents an alkylene group; $L_4$ represents $-CH_2CH_2-$ or

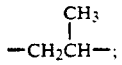

a, c, and d each represents 0 or 1; b represents an integer from 0 to 30; provided that the case a=b=c=d, 0 is excluded therefrom; A, B, and D each represents —O—, —$CO_2$—, or —CO—; Y represents —O— or

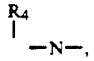

wherein $R_4$ represents a hydrogen atom or an alkyl group;

X is a cross-linking group containing an activated vinyl component, and represented by formulae (III) or (IV):

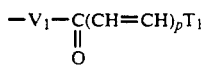

(III)

-continued

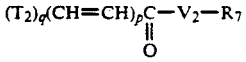

(IV)

wherein $V_1$ and $V_2$ each has the same meaning as Y;

$T_1$ represents an aryl group,

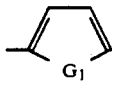

or

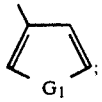

and $G_1$ represents —O— or —S—;

$T_2$ represents an arylene group,

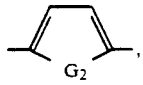

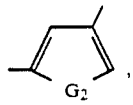

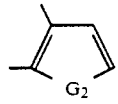

or

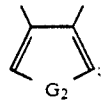

and $G_2$ has the same meaning as $G_1$; Z represents a counter ion for balancing the electric charge;

$R_7$ represents a hydrogen atom, or an unsubstituted or substituted alkyl group, alkenyl group, aryl group or aralkyl group; and p is 1 or 2; and

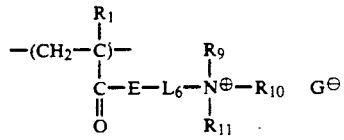

(V)

wherein $R_1$ has the same meaning as $R_1$ in formula (I); $R_9$, $R_{10}$, and $R_{11}$ each having the same meaning as $R_2$ in formula (I) and any two or all of $R_9$, $R_{10}$, and $R_{11}$ may be condensed together to complete a ring; and E, $L_6$, and G have the same meanings as Y, $L_1$, and Z in formula (I), respectively.

2. A silver halide photographic element as in claim 1, wherein the high molecular weight compound has an average molecular weight, as based on polyethylene oxide, of from 2,000 to 2,000,000.

3. A silver halide photographic element as in claim 1, wherein the high molecular weight compound is incorporated into a subbing layer.

4. A silver halide photographic element as in claim 1, wherein X is selected from the group consisting of

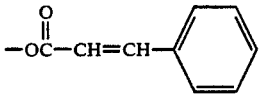

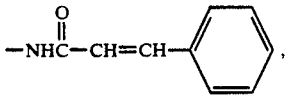

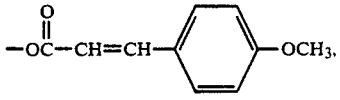

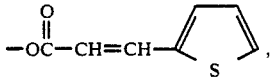

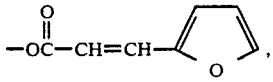

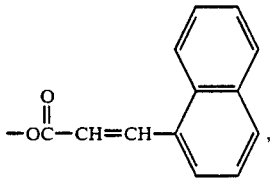

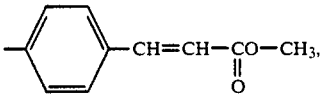

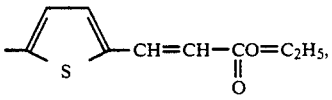

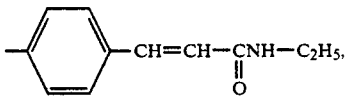

and

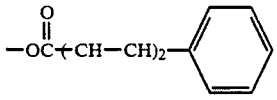

5. A silver halide photographic element as in claim 1, wherein $L_1$ and $L_2$ are each independently selected from the group consisting of $-CH_2-$, $-(CH_2)_2-$, $-(CH_2)_3-$, $-(CH_2)_4-$, $-(CH_2)_6-$, $-CH_2-O-CH_2-$, $-CH_2CH_2-O-CH_2CH_2-$, $-CH_2CH_2-NH-CH_2-CH_2-$, $-CH_2CH_2(O-CH_2CH_2)_2-$, $-CH_2CH_2(O-CH_2CH_2)_3-$, $-CH_2CH_2(O-CH_2CH_2)_4-$, $-CH_2CH_2(O-CH_2CH_2)_7-$, $-CH_2CH_2(O-CH_2CH_2)_9-$, $-CH_2CH_2(O-CH_2CH_2)_2OC(=O)-CH_2-$, $-CH_2CH_2(O-CH_2CH_2)_2OC(=O)(CH_2)_3-$, $-CH_2CH_2(O-CH_2CH_2)_9O-C(=O)-C(CH_2)_3-$, and $-CH_2CH_2-(O-CH_2CH_2)_4-NHCO-(CH_2)_3-$.

6. A silver halide photographic element as in claim 1, wherein formula (I) represents a repeating unit derived from monomer (C-1):

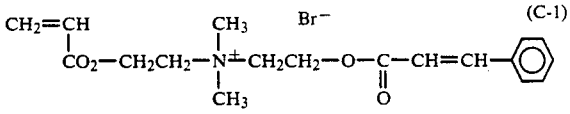

(C-1)

and monomer (C-1) is present in a fraction of 20 mol % of the high molecular weight compound, and wherein formula (V) represents a repeating unit derived from monomer (D-1):

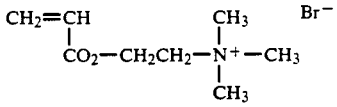

(D-1)

and monomer (D-1) is present in a fraction of 80 mol % of the high molecular weight compound.

7. A silver halide photographic element as in claim 6, wherein the high molecular weight compound has a weight average molecular weight of about 160,000.

8. A silver halide photographic element as in claim 1, wherein the high molecular weight compound is contained in an amount of from 0.0001 to 0.5 g/m$^2$ of the photographic element.

* * * * *